US008813427B2

(12) United States Patent
Meeks

(10) Patent No.: US 8,813,427 B2
(45) Date of Patent: Aug. 26, 2014

(54) THRESHOLD ASSEMBLY HAVING A RAIL AND A DRAINAGE ELEMENT

(71) Applicant: Quanex Corporation, Houston, TX (US)

(72) Inventor: James W. Meeks, Eaton, OH (US)

(73) Assignee: Quanex Corporation, Houston, TX (US)

( * ) Notice: Subject to any disclaimer, the term of this patent is extended or adjusted under 35 U.S.C. 154(b) by 0 days.

(21) Appl. No.: 13/897,166

(22) Filed: May 17, 2013

(65) Prior Publication Data

US 2013/0305610 A1 Nov. 21, 2013

Related U.S. Application Data

(60) Provisional application No. 61/648,388, filed on May 17, 2012.

(51) Int. Cl.
*E06B 1/70* (2006.01)

(52) U.S. Cl.
USPC ..... 49/471; 49/467; 49/470

(58) Field of Classification Search
USPC ..... 49/467, 469, 470, 471, 468, 475.1, 49/489.1, 498.1, 495.1; 52/209
See application file for complete search history.

(56) References Cited

U.S. PATENT DOCUMENTS

| | | | | |
|---|---|---|---|---|
| 220,460 | A | | 10/1879 | York |
| 313,742 | A | | 3/1885 | Kintner |
| 435,658 | A | | 9/1890 | Brennaman |
| 600,301 | A | | 3/1898 | Barger |
| 618,013 | A | | 1/1899 | Roeder |
| 1,468,958 | A | | 9/1923 | Champion |
| 1,700,152 | A | | 1/1929 | Beck |
| 1,729,243 | A | | 9/1929 | Bricker |
| 1,795,853 | A | | 3/1931 | Glass |
| 2,022,408 | A | | 11/1935 | Dahl |
| 2,065,078 | A | | 12/1936 | Lane |
| 2,077,845 | A | | 4/1937 | Madsen |
| 2,108,137 | A | * | 2/1938 | Oftedal et al. ..... 49/471 |
| 2,129,381 | A | | 9/1938 | Otfedal et al. |
| 2,293,292 | A | | 12/1939 | Goellner |

(Continued)

OTHER PUBLICATIONS

Article entitled "Products on Display At AMD" dated Oct. 15, 2012, 4 pagesextracted from www.dwmmag.com/index.php/products-on-display-at-amd/.

(Continued)

*Primary Examiner* — Jerry Redman
(74) *Attorney, Agent, or Firm* — Howard & Howard Attorneys PLLC

(57) ABSTRACT

A threshold assembly for use with an entryway system disposed within a structure having an exterior and an interior. The threshold assembly has a sill base extending between an exterior side for facing the exterior and an interior side for facing the interior. The threshold assembly has a rail disposed above the sill base and movable between initial and sealed positions. The threshold assembly has a drainage element disposed beneath the rail having a height relative to the sill base and sloping away from the interior side of the sill base such that the height decreases from the interior side to the exterior side for providing positive drainage of any fluid that may infiltrate beyond the rail from the threshold assembly at the exterior side. The threshold assembly has a biasing member coupled to the rail and contacting the drainage element and biasing the rail into the initial position.

24 Claims, 16 Drawing Sheets

(56) References Cited

U.S. PATENT DOCUMENTS

| | | | | |
|---|---|---|---|---|
| 2,264,632 | A | 4/1940 | Goellner | |
| 2,202,482 | A | 5/1940 | Dahl | |
| 2,264,634 | A | 12/1941 | Goellner | |
| 2,555,244 | A | 5/1951 | Pietrushak | |
| 2,663,056 | A | 12/1953 | Hardgrave | |
| 2,934,802 | A | 11/1956 | Shekter | |
| 2,818,614 | A | 1/1958 | Lapka, Jr. | |
| 3,762,100 | A | 10/1973 | Kempel | |
| 4,310,991 | A * | 1/1982 | Seely | 49/470 |
| 4,513,536 | A | 4/1985 | Giguere | |
| 4,565,033 | A | 1/1986 | Tinfow | |
| 4,628,639 | A | 12/1986 | Lownsdale | |
| 4,831,779 | A | 5/1989 | Kehrli et al. | |
| 5,018,307 | A * | 5/1991 | Burrous et al. | 49/471 |
| 5,067,279 | A * | 11/1991 | Hagemeyer | 49/471 |
| 5,136,814 | A | 8/1992 | Headrick | |
| 5,179,804 | A | 1/1993 | Young | |
| D354,572 | S | 1/1995 | Headrick | |
| 5,426,894 | A | 6/1995 | Headrick | |
| 5,588,266 | A | 12/1996 | Headrick | |
| 5,611,173 | A | 3/1997 | Headrick et al. | |
| 5,943,825 | A | 8/1999 | Procton et al. | |
| 6,052,949 | A | 4/2000 | Procton et al. | |
| 6,219,971 | B1 | 4/2001 | Headrick | |
| 6,367,201 | B1 | 4/2002 | Massey et al. | |
| 6,371,188 | B1 | 4/2002 | Baczuk et al. | |
| 6,789,358 | B2 | 9/2004 | Procton et al. | |
| 7,350,336 | B2 | 4/2008 | Bennett | |
| 7,472,516 | B2 | 1/2009 | Pepper et al. | |
| 7,600,346 | B2 * | 10/2009 | Meeks | 49/471 |
| 7,644,539 | B2 * | 1/2010 | Baxter | 49/303 |
| 7,669,369 | B2 | 3/2010 | Henry et al. | |
| D638,958 | S | 5/2011 | Van Camp et al. | |
| 8,240,090 | B2 | 8/2012 | Meeks et al. | |
| 8,522,483 | B2 | 9/2013 | Van Camp et al. | |
| 2006/0283087 | A1 * | 12/2006 | Baxter | 49/306 |
| 2008/0010904 | A1 | 1/2008 | Meeks et al. | |
| 2013/0047518 | A1 | 2/2013 | Van Camp et al. | |
| 2013/0199100 | A1 * | 8/2013 | Van Camp et al. | 49/468 |

OTHER PUBLICATIONS

Product Overview entitled "Z-Series Articulating Cap", extracted from www.enduraproducts.com/product-overview/sills/z-series/Z-Series%20Articulating%20Cap.aspx on Dec. 28, 2012, 2 pages.

Product Overview entitled "Z-Series Cap Replacement Instructions", extracted from http://www.enduraproducts.com/images/NewLit%20-%20Inst%20-%20broch%20-%202011/Z%20Series%20Cap%20Replacemenr/0201nstructions.pdf on Aug. 22, 2013, 3 pages.

Product Overview entitled "Performance At the Reality Level Z-Articulating Cap Sill", extracted from http://www.enduraproducts.com/docs-literature/lit-instruc-warr-sizes-pdf/web-prod-literature/Z-AC%2011_13_12_web.pdf on Aug. 22, 2013, 8 pages.

* cited by examiner

THRESHOLD ASSEMBLY HAVING A RAIL AND A DRAINAGE ELEMENT

RELATED APPLICATION

This application claims priority to and all advantages of U.S. Provisional Patent Application No. 61/648,388, which was filed on May 17, 2012, the disclosure of which is specifically incorporated by reference.

BACKGROUND OF THE INVENTION

1. Field of the Invention

The subject invention relates to a threshold assembly for an entryway system.

2. Description of Related Art

Threshold assemblies are used with entryway systems to seal between a rail of the threshold assembly and a door panel of the entryway system. The entryway system typically includes a door frame and the door panel. Threshold assemblies typically include a sill base with the rail disposed on the sill base below the door panel when the door panel is in a closed position. The rail may be biased to engage and adjust to the door panel to create a water-tight seal between the rail and the door panel. In other words, as opposed to setting the door panel and/or the rail to a predetermined height relative to each other at the time of installation to create a proper seal between the door panel and the rail, the rail instead self-adjusts to the door panel when the door panel is in the closed position to seal against the door panel.

Traditionally, the rail is biased toward the door panel such that the door panel engages the rail and the rail seals against the door panel. Water that infiltrates the threshold assembly beyond the rail typically is trapped within the sill and unable to drain from the threshold assembly. As such, there remains a need to provide an improved threshold assembly.

SUMMARY OF THE INVENTION AND ADVANTAGES

The subject invention provides for a threshold assembly for use with an entryway system disposed within a structure, which has an exterior and an interior. The threshold assembly comprises a sill base extending between an exterior side for facing the exterior of the structure and an interior side for facing the interior of the structure. The threshold assembly further comprises a rail coupled to and disposed above the sill base with the rail movable relative to the sill base between an initial position having a first distance relative to the sill base and a sealed position having a second distance relative to the sill base with the first distance greater than the second distance for preventing intrusion of a fluid from the exterior to the interior of the structure. The threshold assembly also comprises a drainage element disposed beneath the rail and having a height relative to the sill base with the drainage element sloping away from the interior side of the sill base such that the height of the drainage element decreases from the interior side of the sill base to the exterior side of the sill base for providing positive drainage of any fluid that may infiltrate beyond the rail from the threshold assembly at the exterior side. Furthermore, the threshold assembly comprises a biasing member coupled to the rail and contacting the drainage element with the biasing member biasing the rail away from the drainage element into the initial position.

Accordingly, the drainage element provides positive drainage of the fluid that infiltrates the threshold assembly beyond the rail to prevent the threshold assembly from retaining the fluid or, worse yet, forcing the fluid into the structure. Providing positive drainage reduces the susceptibility of mold growth and rotting within the threshold assembly. Furthermore, the positioning of the biasing member beneath the rail limits the generation of a moment force within the biasing member which increases the resiliency of the biasing member.

BRIEF DESCRIPTION OF THE DRAWINGS

Advantages of the subject invention will be readily appreciated as the same becomes better understood by reference to the following detailed description when considered in connection with the accompanying drawings.

DETAILED DESCRIPTION OF THE INVENTION

Figure 1:
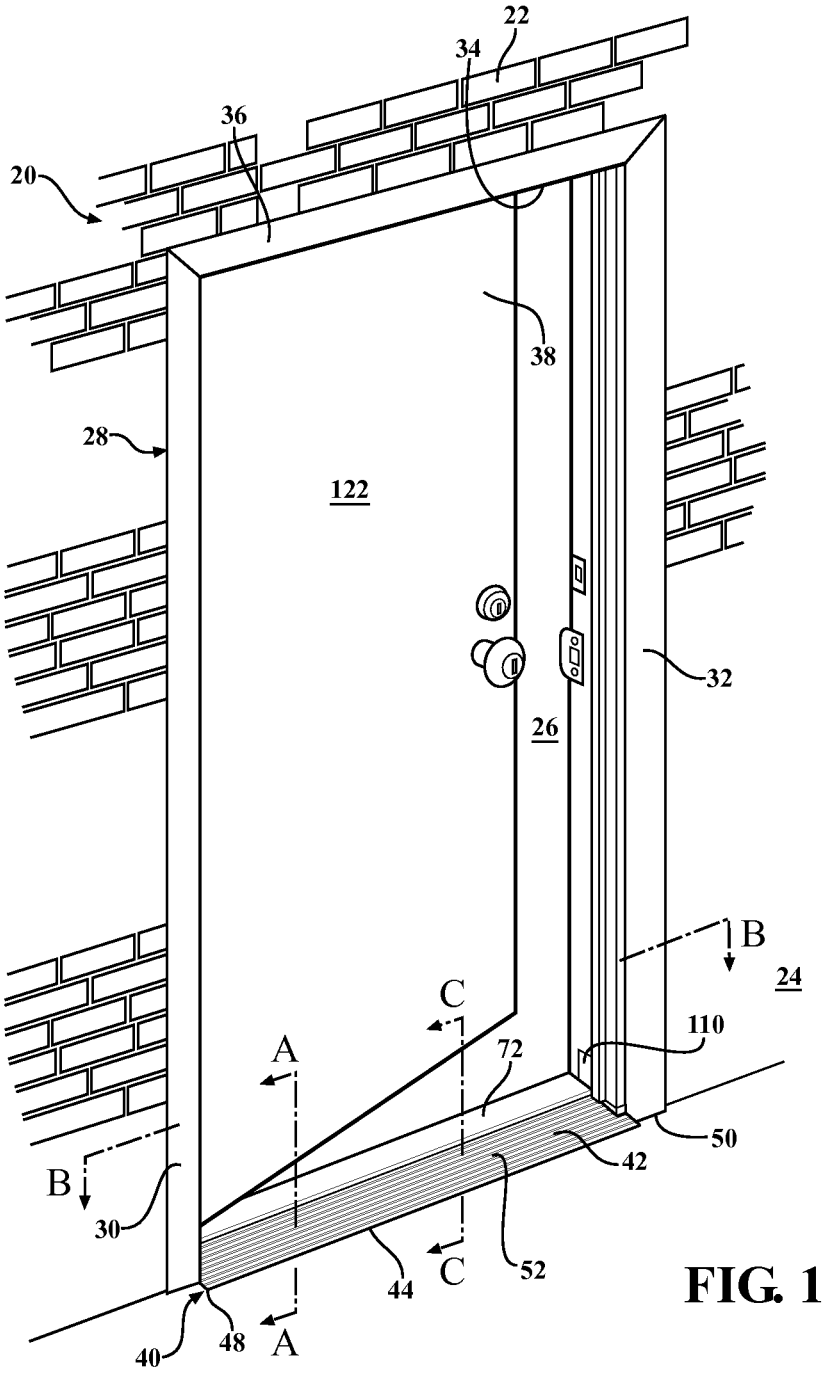
FIG. 1 is a perspective view of an entryway system showing a door frame, a door panel, and a threshold assembly, with the door panel in a closed position.

Referring to the Figures, wherein like numerals indicate like or corresponding parts throughout the several views, an entryway system 20 for disposing within an aperture of a structure 22 is generally shown in FIG. 1. The structure 22 is typically a building, such as a commercial or residential building, with the entryway system 20 providing access into the structure 22. The structure 22 defines an exterior 24 and an interior 26. More specifically, the structure 22 has a wall dividing the exterior 24 (outside environment) and the interior 26 of the structure 22. The entryway system 20 is disposed within the aperture to separate the exterior 24 and the interior 26 of the structure 22. Said differently, the exterior 24 and the interior 26 are disposed on opposite sides of the entryway system 20. As such, the entryway system 20 can be used to access the exterior 24 from the interior 26 of the structure and, alternatively, the entryway system 20 can be used to access the interior 26 from the exterior 24 of the structure. It is to be appreciated that the entryway system 20 may be utilized in any suitable configuration for providing access therethrough the wall of the structure 22.

The entryway system 20 includes a door frame 28 disposed in the aperture of the structure 22. The door frame 28 includes first and second door jambs 30, 32 spaced from each other. The door frame 28 defines an opening 34 for providing access between the interior 26 and the exterior 24 of the structure 22. Typically, the first and second door jambs 30, 32 are substantially parallel to one another. However, it is to be appreciated that the first and second door jambs 30, 32 may be disposed transverse to one another or in any other suitable configuration. The door frame 28 typically includes a door head 36 transverse to and extending between the first and second door jambs 30, 32.

Figure 2:
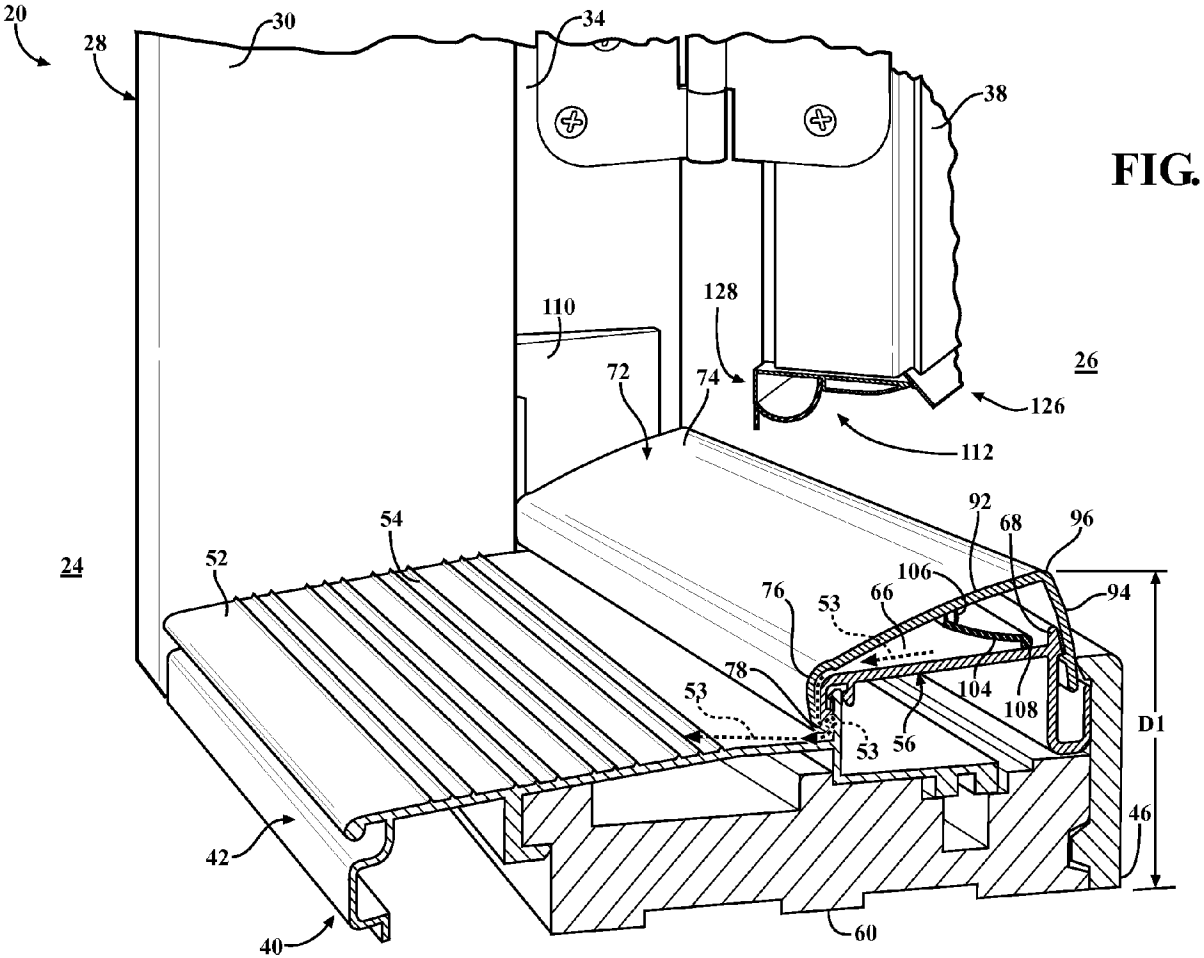
FIG. 2 is a perspective view of a portion of the entryway system showing a cross-section of the threshold assembly along A-A of FIG. 1 with the door panel in an open position.
Figure 8:
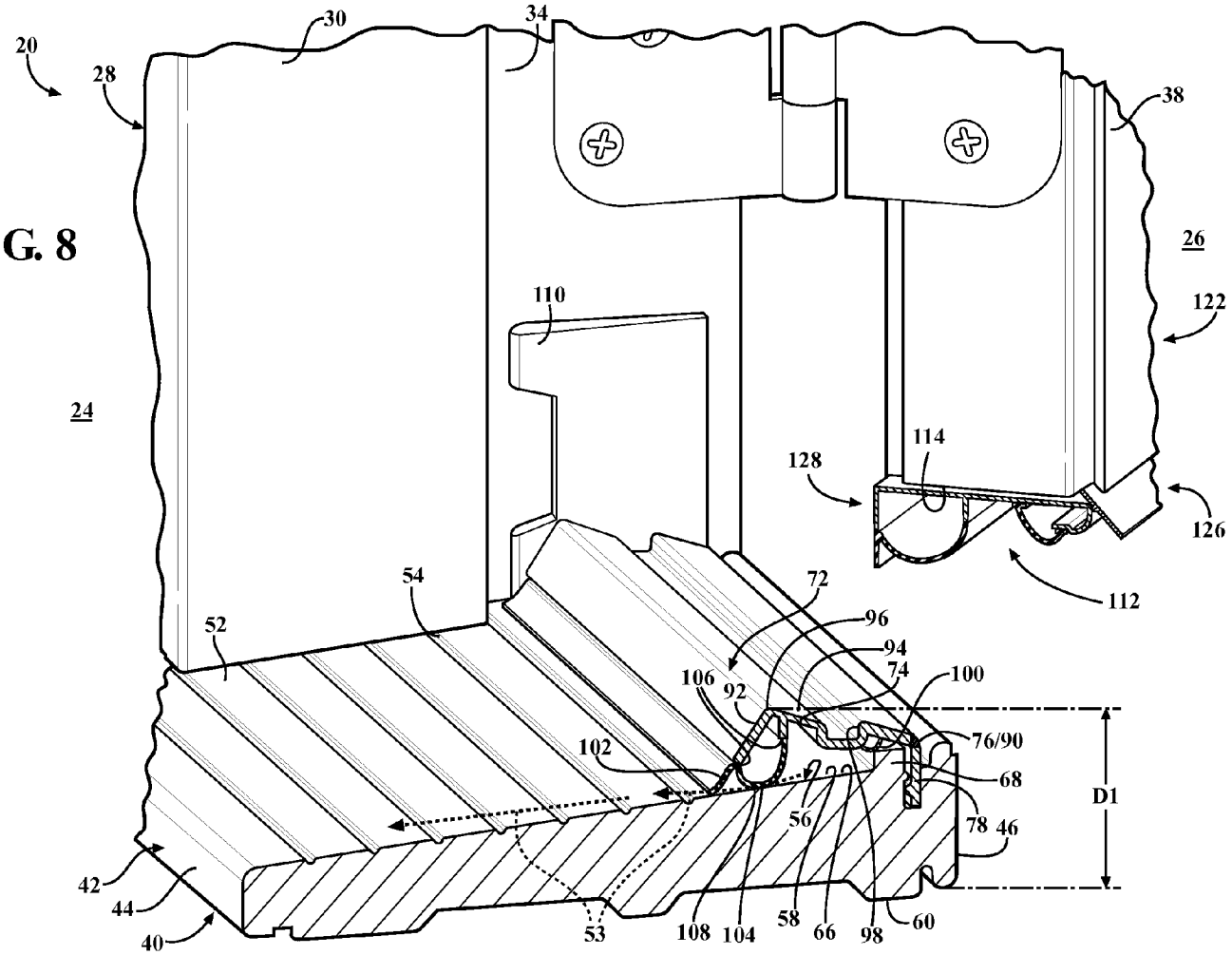
FIG. 8 is a perspective view of a portion of the entryway system showing a cross-section of an alternative embodiment of the threshold assembly along A-A of FIG. 1 with the door panel in the open position.
Figure 9:
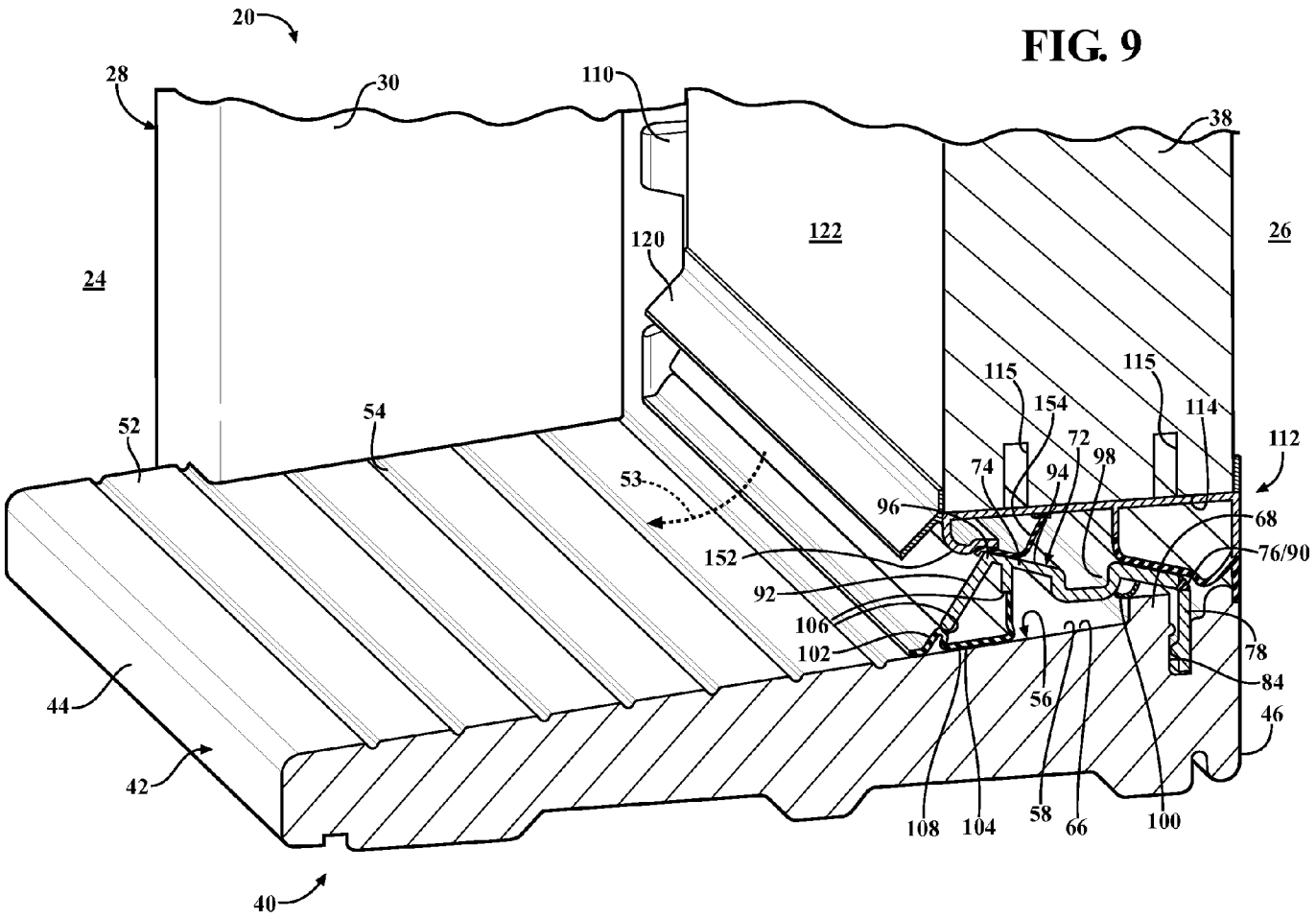
FIG. 9 is a perspective view of a portion of the entryway system showing a cross-section of the alternative embodiment of the threshold assembly along A-A of FIG. 1 with the door panel in the completely closed position.

The entryway system 20 includes a door panel 38 coupled to the door frame 28 and capable of moving between an open position, as shown in FIGS. 2 and 8, and a closed position, as shown in FIG. 9. When in the closed position, the door panel 38 disposed in the opening 34 in the closed position. The door panel 38 is typically pivotably coupled to one of the first and second door jambs 30, 32. The door panel 38 is pivotably coupled to the first door jamb 30 in the Figures for exemplary purposes only. The movement of the door panel 38 between the open and closed positions may be further defined as pivoting between the open and closed positions. Said differently, the door panel 38 is hinged to one of the first and second door jambs 30, 32. The door panel 38 is disposed entirely outside of the opening 34 in the open position. The closed position refers to any position of the door panel 38 in which at least a portion of the door panel 38 extends into the opening 34. The closed position may further define a completely closed position in which the door panel 38 is entirely disposed within the opening 34. In the completely closed position, the door panel 38 may abut the door frame 28 to substantially inhibit access through the opening 34.

Figure 3:
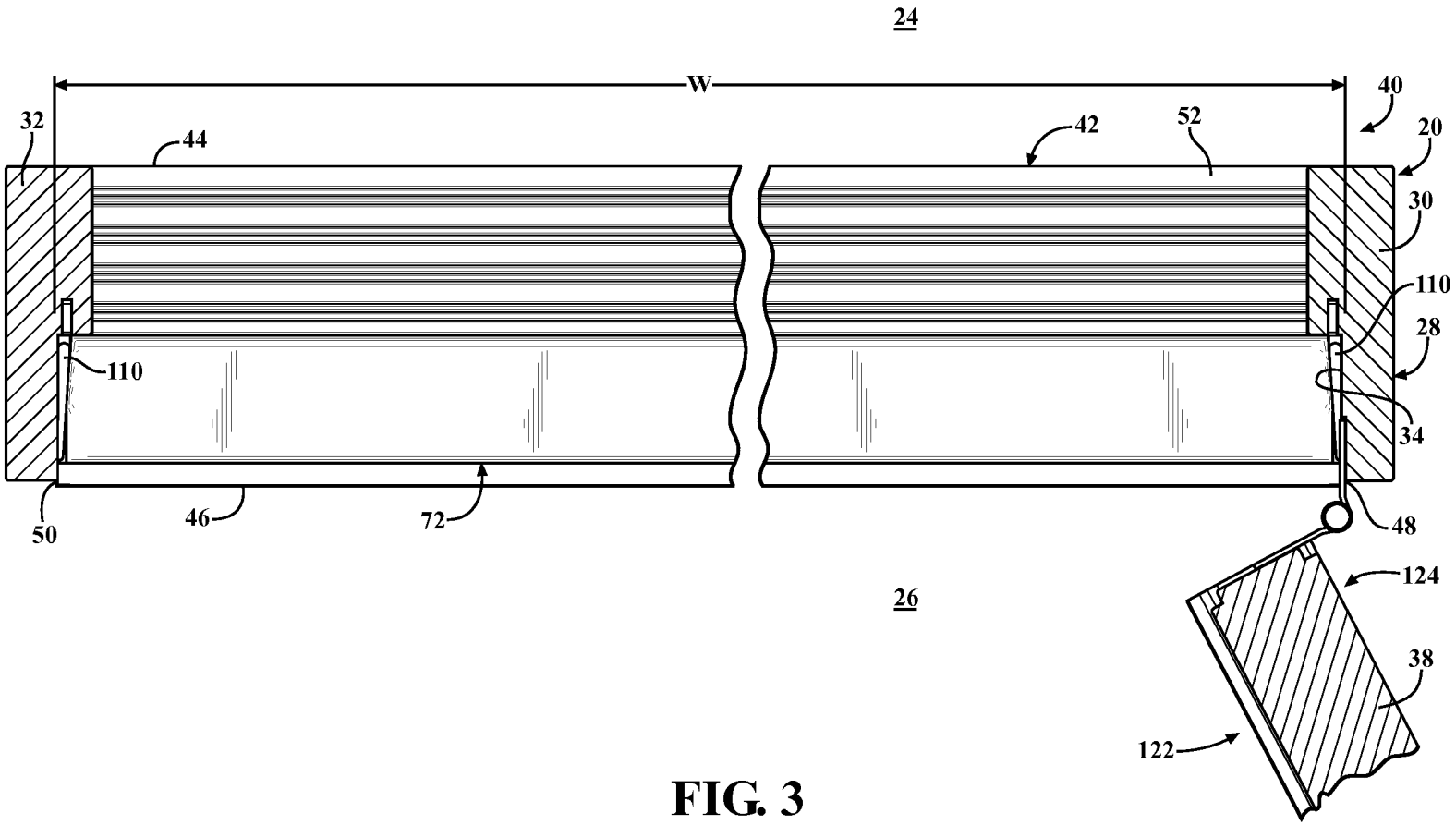
FIG. 3 is a top elevational view of the entryway system showing the threshold assembly and showing the door frame and the door panel in cross-section along B-B of FIG. 1 with the door panel in the open position.
Figure 10:
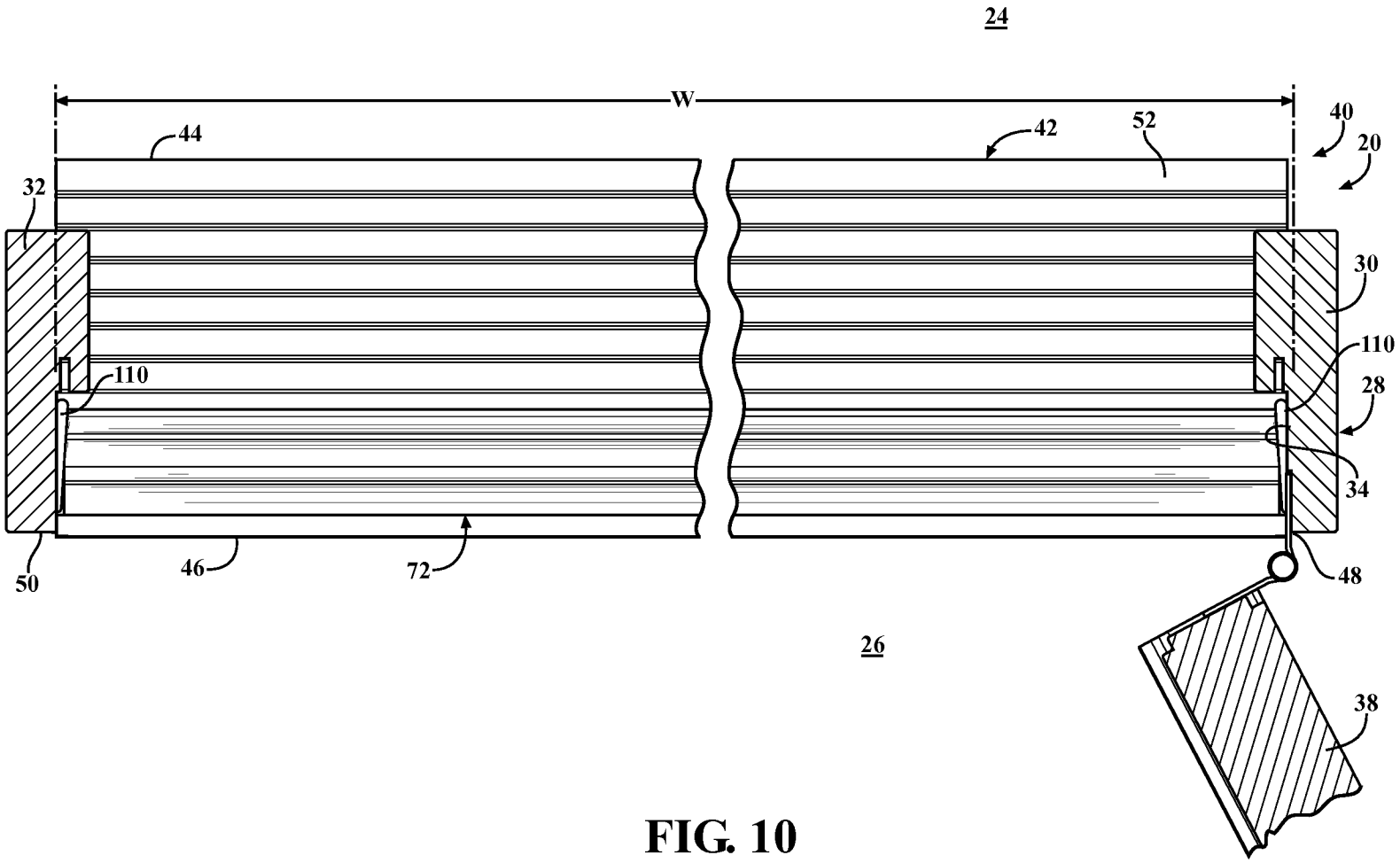
FIG. 10 is a top elevational view of the entryway system showing a cross-section of the alternative embodiment of the threshold assembly along B-B of FIG. 1 with the door panel in the open position.

As shown in FIGS. 3 and 10, the entryway system 20 includes a threshold assembly 40 disposed between the first and second door jambs 30, 32. As shown in FIGS. 2 and 8, the threshold assembly 40 is also disposed below the door panel 38 with the door panel 38 contacting the threshold assembly 40 in the closed position, as best illustrated in FIG. 9. As shown in FIG. 1, the threshold assembly 40 is disposed within the opening 34 opposite the door head 36 and typically extends toward each of the first and second door jambs 30, 32. It is to be appreciated that the threshold assembly 40 may be disposed anywhere within the opening 34.

As shown in FIGS. 3 and 10, the threshold assembly 40 includes a sill base 42 extending between an exterior side 44 which faces the exterior 24 of the structure 22 and an interior side 46 which faces the interior 26 of the structure 22. The sill base 42 extends between a first end 48 and a second end 50 defining a width W of the sill base 42. Typically, the first end 48 of the sill base 42 is adjacent the first door jamb 30 and the second end 50 is adjacent the second door jamb 32. More typically, the first end 48 abuts the first door jamb 30 and the second end 50 abuts the second door jamb 32. However, it is to be appreciated that one or both of the first and second ends 48, 50 may be spaced from the first and second door jambs 30, 32, respectively.

As shown in FIGS. 2 and 8, the sill base 42 may present a tread surface 52 adjacent the exterior side 44 and extending toward the interior side 46. The tread surface 52 is sloped downwardly away from the interior side 46 of the sill base 42. The slope of the tread surface 52 promotes positive drainage of any fluid 53 that may contact the tread surface 52. Said differently, the slope of the tread surface 52 directs fluid 53 from the threshold assembly 40 toward the exterior 24 of the structure 22. Positive drainage typically refers to a desired drainage path of the fluid 53 whereas negative drainage typically refers to an undesired drainage path of the fluid 53. For example, positive drainage is the movement of the fluid 53 away from the interior 26 of the structure 22 and toward the exterior 24 of the structure 22, and negative drainage is the movement of the fluid 53 away from the exterior 24 of the structure 22 and toward the interior 26 of the structure 22.

As set forth in the present application, the term drainage typically refers to movement of the fluid 53, which is typically water. However, it is to be appreciated that the drainage may refer to the movement of any fluid 53, including any debris that may be entrapped within the fluid 53. Furthermore, drainage may also refer to the movement of any object that is desired to be removed from the threshold assembly 40.

The tread surface 52 may also define a plurality of grooves 54 spaced from and parallel to one another and extending longitudinally along the sill base 42. The grooves 54 collect and direct the fluid 53, which poses a slipping hazard to a person stepping on the tread surface 52.

Figure 4:
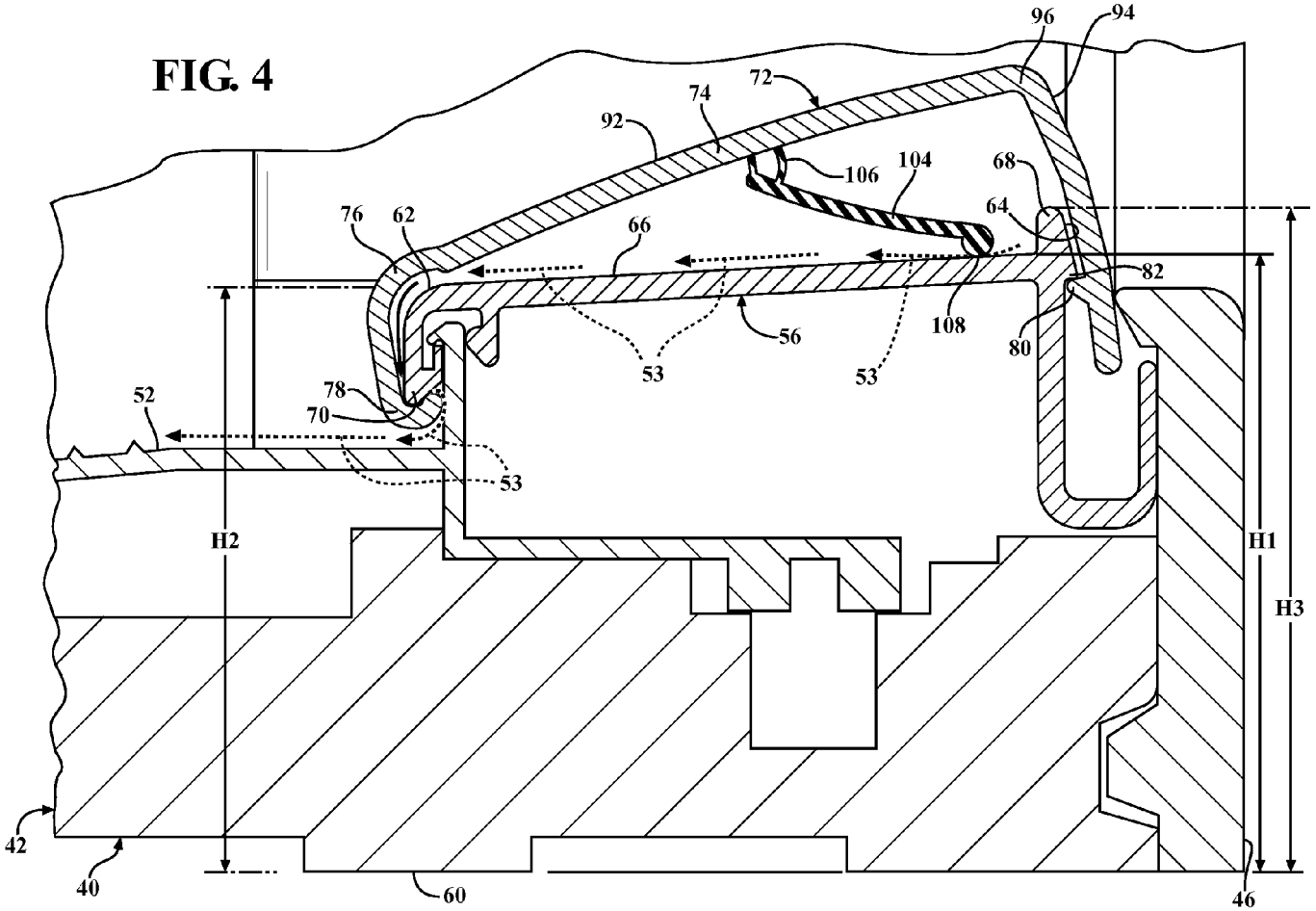
FIG. 4 is a cross-sectional view of the threshold assembly along A-A of FIG. 1 showing a rail shown in an initial position.
Figure 11:
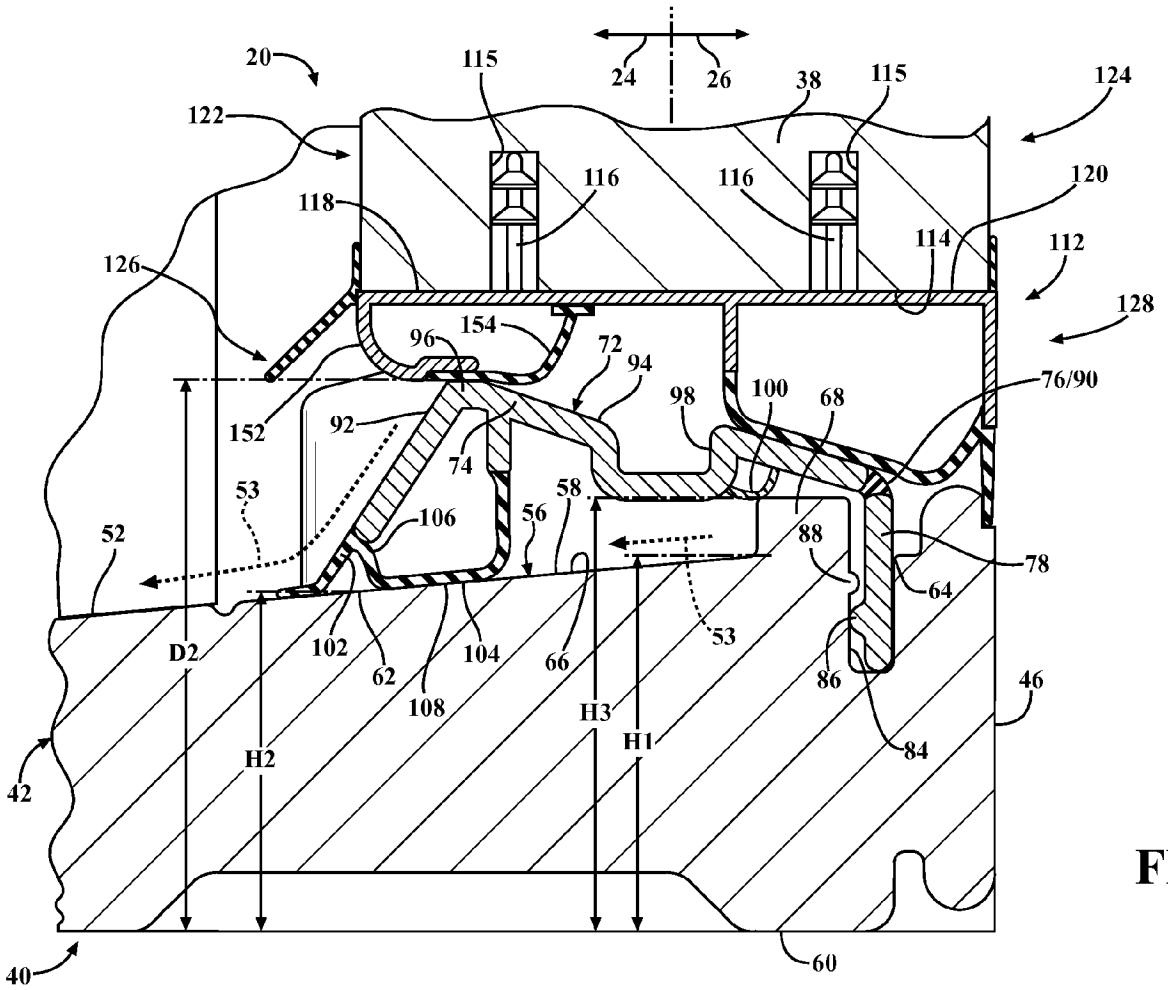
FIG. 11 is a cross-sectional view of the alternative embodiment of the threshold assembly and the door panel along A-A of FIG. 1 with the door panel in the completely closed position and showing the rail in the sealed position.

The threshold assembly 40 includes a drainage element 56. The drainage element 56 is coupled to the sill base 42. As shown in FIG. 4, the drainage element 56 may be an independent component which is coupled to the sill base 42. Alternatively, as shown in FIG. 11, the sill base 42 may have an external surface 58 with the drainage element 56 further defined as the external surface 58 of the sill base 42. As such, the drainage element 56 and the sill base 42 may be a unitary component.

As shown in FIGS. 4 and 11, the drainage element 56 has a height relative to the sill base 42. The sill base 42 has a bottom surface 60 facing away from the drainage element 56. Typically, the structure 22 has a floor with the bottom surface 60 contacting the floor. The height of the drainage element 56 is measured from the bottom surface 60 of the sill base 42.

The drainage element 56 slopes away from the interior side 46 of the sill base 42 such that the height of the drainage element 56 decreases from the interior side 46 of the sill base 42 to the exterior side 44 of the sill base 42 for providing positive drainage of any fluid 53 that may infiltrate the threshold assembly 40. Said differently, the slope of the drainage element 56 directs fluid 53 from within the threshold assembly to the exterior 24 of the structure 22. The drainage element 56 extends to a first side 62 toward the interior side 46 of the sill base 42 and a second side 64 toward the exterior side 44 of the sill base 42.

The drainage element 56 may define a drainage surface 66. The drainage surface 66 extends toward the interior and exterior sides 44, 46 of the sill base 42. Said differently, the drainage surface 66 typically extends toward the first and second sides 62, 64 of the drainage element 56. The drainage surface 66 may define the sloping away of the drainage element 56. More specifically, the height of the drainage element 56 measured along the drainage surface 66 at the first side 62 of the drainage element 56 is further defined as a first height H1. The height of the drainage element 56 measured along the drainage surface 66 at the second side 64 of the drainage element 56 is further defined as a second height H2. The first height H1 of the drainage element 56 along the drainage surface 66 is greater than the second height H2 of the drainage element 56 along the drainage surface 66 which provides positive drainage. As discussed above, the sill base 42 may have the tread surface 52. The slope of the drainage surface 66 along the drainage element 56 provides positive drainage of the fluid 53 from the drainage element 56 to the tread surface 52, which is sloped to provide positive drainage from the threshold assembly 40 at the exterior 24 of the structure 22.

The drainage element 56 may define a dam 68 extending toward the rail 72 for preventing backflow toward the interior side 46 of the sill base 42. As set forth in the present application, the term "backflow" refers to a type of negative drainage. As an example, backflow is when the fluid 53 is forced from the exterior side 44 of the sill base 42 toward the interior side 46 of the sill base 42. Such backflow may occur due to wind forcing the fluid 53 up the drainage surface 66.

Typically, the dam 68 projects into the opening 34 at the first side 62 of the drainage element 56 with the drainage surface 66 extending from the dam 68 toward the second side 64 of the drainage element 56. The height of the drainage element 56 at the dam 68 is further defined as a third height H3 which is greater than each of the first and second heights H1, H2. Typically, the dam 68 extends longitudinally between the first and second door jambs 30, 32.

The third height H3 of the dam 68 is typically greater than the first and second heights H1, H2 of the drainage element 56 along the drainage surface 66. The third height H3 of the dam 68 acts to block backflow of the fluid 53 across the threshold assembly 40 and into the interior 26 of the structure 22.

As shown in FIG. 4, the drainage element 56 may have a protrusion 70. The protrusion 70 extends toward each of the tread surface 52 and the exterior side 44 of the sill base 42. The purpose of the protrusion 70 will be better appreciated through further description below.

As shown in FIGS. 2 and 8, the threshold assembly 40 includes a rail 72 coupled to and disposed above the sill base 42. The drainage element 56 is disposed beneath the rail 72. More specifically, the drainage surface 66 of the drainage element 56 may be disposed beneath and face the rail 72. Typically, the drainage element 56 and the drainage surface 66 are disposed directly beneath the rail 72. However, it is to be appreciated that the drainage element 56 and the drainage surface 66 may extend out from underneath the rail 72.

As shown in FIGS. 3 and 10, the rail 72 may extend between the first and second ends 48, 50 of the sill base 42. More specifically, the rail 72 typically extends toward the first and second ends 48, 50 of the sill base 42 such that the rail 72 extends along the entire width W of the sill base 42. However, it is to be appreciated that the rail 72 may extend along only a portion of the sill base 42. It is also to be appreciated that the rail 72 may extend past the first and second ends 48, 50 of the sill base 42. The rail 72 is typically spaced from each of the first and second door jambs 30, 32. However, the rail 72 may extend to and contact one or both of the first and second door jambs 30, 32. The door panel 38 engages the rail 72 along the width W of the sill base 42 for sealing the opening 34 of the door frame 28 beneath the door panel 38, which will be discussed in greater detail below.

The rail 72 is movable relative to the sill base 42 between an initial position having a first distance D1 relative to the bottom surface 60 of the sill base 42 when the door panel 38 is in the open position, as shown in FIGS. 2 and 8, and a sealed position having a second distance D2 relative to the bottom surface 60 of the sill base 42 when the door panel 38 is in the closed position, as shown in FIGS. 5-7 and 11. The rail 72 may define an apex 96. The apex 96 is the largest distance from the bottom surface 60 of the sill base 42. The first and second distances D1, D2 are measured from the bottom surface 60 of the sill base 42 to the apex 96 of the rail 72 as shown in the FIGS. 2, 5-8, and 11. The first distance D1 of the rail 72 in the initial position occurs when the door panel 38 is in the open position. The second distance D2 of the rail 72 in the sealed position occurs when the door panel 38 is in the closed position. The first distance D1 is greater than the second distance D2 for allowing said rail 72 to adjust closer to the sill base 42. The rail 72 adjusts within the entryway system 20. Adjustment of the rail 72 within the entryway system 20 prevents intrusion of the fluid 53 from the exterior 24 of the structure 22 to the interior 26 of the structure 22 by sealing against the door panel 38. More specifically, movement of the rail 72 within the entryway system 20 occurs as the door panel 38 contacts and forces the rail 72 from the initial position toward the sill base 42 and the sealed position as the door panel 38 moves from the open position to the closed position. As such, the threshold assembly 40 is commonly referred to as a self-adjustable threshold assembly in the art. Said differently, the distance D1, D2 is automatically adjusted as the door panel 38 engages the rail 72, which forces the rail 72 toward the sill base 42 while the door panel 38 remains in contact with the rail 72 to seal the opening 34. The self-adjustment of the rail 72 will be better understood through further description below.

As shown in FIGS. 4 and 11, the rail 72 may have a body portion 74 and a hinge portion 76 coupled to the body portion 74. The hinge portion 76 is coupled to the drainage element 56. The movement of the rail 72 is further defined as pivoting the body portion 74 relative to the sill base 42 about the hinge portion 76.

In one embodiment, as shown in FIG. 4, the rail 72 may include a leg portion 78 extending from the hinge portion 76 opposite the body portion 74 for coupling the hinge portion 76 with the drainage element 56. In one embodiment, the leg portion 78 is wrapped around the protrusion 70 of the drainage element 56 for coupling the hinge portion 76 with the drainage element 56. The engagement of the leg portion 78 and the protrusion 70 facilitates sliding of the leg portion 78 relative to the protrusion 70 such that the body portion 74 pivots about the hinge portion 76. The engagement of the leg portion 78 and the protrusion 70 is similar to that of a cylindrical joint, as is known in the art, with the protrusion 70 functioning much like a pin of the cylindrical joint and the leg portion 78 sliding about the protrusion 70.

The rail 72 may have a first hook 80 and the drainage element 56 may have a second hook 82 with the first hook 80 selectively engaging the second hook 82 for coupling the rail 72 to the sill base 42. The first hook 80 is typically disposed on the body portion 74 of the rail 72 spaced from the hinge portion 76 with the first hook 80 extending toward the hinge portion 76. The second hook 82 is typically disposed on the drainage element 56 opposite the protrusion 70 with the protrusion 70 and the second hook 82 extending away from each other. The first hook 80 is disposed below the second hook 82. More specifically, the first hook 80 is between the second hook 82 and the sill base 42. The first hook 80 engages the second hook 82 when the rail 72 is in the initial position. The engagement of the first hook 80 with the second hook 82 prevents further pivoting of the body portion 74 about the hinge portion 76 beyond the initial position, which would disengage the leg portion 78 from the protrusion 70.

As set forth in the present embodiment, typically the body portion 74, the hinge portion 76, and the leg portion 78 of the rail 72 comprise a rigid plastic. Said differently, the body portion 74, the hinge portion 76, and the leg portion 78 of the rail 72 are made from a rigid plastic. However, it is to be appreciated that the body portion 74, the hinge portion 76, and the leg portion 78 may comprise any material having the desired rigidity. Furthermore, the body portion 74, the hinge portion 76, and the leg portion 78 are typically produced using an extrusion process. However, it is to be appreciated that the process for producing the body portion 74, the hinge portion 76, and the leg portion 78 may be any suitable manufacturing process.

As set forth in the present embodiment the drainage element 56 is typically the independent component as described above. Said differently, the drainage element 56 is a separate component relative to the sill base 42. It is to be appreciated that the drainage element 56 may be the unitary component with the sill base 42 as described above.

In an alternative embodiment, as shown in FIG. 11, the drainage element 56 may define a recess 84 with the leg portion 78 extending into the recess 84. The leg portion 78 may have a protuberance 86 extending toward the exterior side 44 of the sill base 42. The drainage element 56 may define a hump 88 extending into the recess 84 toward the interior side 46 of the sill base 42. The hump 88 is adjacent to the protuberance 86. More specifically, the hump 88 is disposed between the protuberance 86 and the body portion 74 of the rail 72. Translation of the leg portion 78 out of the recess 84 causes the protuberance 86 to engage the hump 88. As such, engagement of the protuberance 86 and the hump 88 retains the leg portion 78 to the drainage element 56.

Although the protuberance 86 extends toward the exterior side 44 of the sill base 42 and the hump 88 extends toward the interior side 46 of the sill base 42, it is to be appreciated that the protuberance 86 may extend toward the interior side 46 of the sill base 42 and the hump 88 may extend toward the exterior side 44 of the sill base 42. Moreover, it is to be appreciated that the protuberance 86 and the hump 88 may be any configuration for retaining the leg portion 78 within the recess 84 of the drainage element 56.

The hinge portion 76 may be further defined as a living hinge 90 with the body portion 74 pivoting about the living hinge 90 relative to the sill base 42. The living hinge 90 is typically a flexible material which allows the body portion 74 to pivot about the living hinge 90. The living hinge 90 typically comprises flexible polyvinyl chloride (PVC). However it is to be appreciated that the living hinge 90 may comprise any other material of suitable flexibility.

As set forth in the present embodiment, typically the body portion 74 and the leg portion 78 of the rail 72 comprise a rigid plastic. However, it is to be appreciated that the body portion 74 and the leg portion 78 may comprise any material having the desired rigidity. Furthermore, the body portion 74 and the leg portion 78 are typically produced using an extrusion process with living hinge 90 typically produced through a co-extrusion process. It is to be appreciated that the process for producing the body portion 74, the living hinge 90, and the leg portion 78 may be any suitable manufacturing process.

As described in the present embodiment the drainage element 56 is typically the unitary component with the sill base 42 as described above. It is to be appreciated that the drainage element 56 may be the independent component as described above or any other suitable configuration.

In one embodiment, the body portion 74 may extend from the hinge portion 76 toward the interior side 46 of the sill base 42, as shown in FIG. 4. In another embodiment, the body portion 74 may extend from the hinge portion 76 toward the exterior side 44 of the sill base 42, as shown in FIG. 11. It is to be appreciated that the hinge portion 76 and the body portion 74 may be disposed in any configuration which facilitates pivoting of the body portion 74 relative to the sill base 42 about the hinge portion 76.

As shown in FIGS. 4 and 11, the rail 72 may have a primary surface 92 and a secondary surface 94 adjacent the primary surface 92. The primary and secondary surfaces 92, 94 are typically disposed on the body portion 74 of the rail 72. The primary and secondary surfaces 92, 94 extend away from each other from the apex 96.

The primary surface 92 slopes away from the interior side 46 of the sill base 42 for providing positive drainage off of the rail 72 toward the exterior side 44 of the sill base 42. More specifically, the primary surface 92 extends from the apex 96 downwardly toward the exterior side 44 of the sill base 42. The slope of the primary surface 92 promotes positive drainage off of the rail 72 toward the tread surface 52.

In an alternative embodiment shown in FIG. 11, the secondary surface 94 may define a channel 98 for preventing negative drainage off of the rail 72 toward the interior side 46 of the sill base 42. The channel 98 typically extends longitudinally along the rail 72 between the first and second ends 48, 50 of the sill base 42. The channel 98 is disposed between the dam 68 and the exterior side 44 of the sill base 42. The secondary surface 94 slopes away from the exterior side 44 of the sill base 42 such that the secondary surface 94 extends from the apex 96 downwardly toward the interior side 46 of the sill base 42. The slope of the secondary surface 94 facilitates movement of the fluid 53, which has passed over the apex 96 of the rail 72, toward the channel 98 with the fluid 53 entering the channel 98. The secondary surface 94 of the rail 72 defining the channel 98 may be solid to retain the fluid 53 in the channel 98. Alternatively, the rail 72 may have a weeping device within the channel 98 to facilitate passage of the fluid 53 from the channel 98 to the drainage surface 66 of the drainage element 56, with the sloping of the drainage element 56 beneath the channel 98 facilitating positive drainage of the fluid 53 from the threshold assembly 40. As one example, the weeping device may be a plurality of apertures extending through the rail 72. As another example, the weeping device may be a water-permissible membrane. It is to be appreciated that the weeping device may be any configuration for allowing water to pass from the channel 98 to the drainage surface 66 of the drainage element 56.

The rail 72 may have a dam seal 100 disposed between the body portion 74 and the drainage element 56. The dam seal 100 typically extends longitudinally along the rail 72. The dam seal 100 is substantially semi-circular in configuration. The dam seal 100 engages the dam 68 defined by the drainage element 56. The dam seal 100 deforms against the dam 68 when the rail 72 is in the sealed position. As such, with the rail 72 in the sealed position, the engagement of the dam seal 100 against the dam 68 creates a seal between the rail 72 and the drainage element 56 to further prevent backflow of the fluid 53 into the interior 26 of the structure 22.

The dam seal 100 is typically comprised of flexible polyvinyl chloride (PVC). However it is to be appreciated that the dam seal 100 may be any other material of suitable flexibility.

The rail 72 may include a fin 102 extending from the body portion 74 toward the exterior side 44 of the sill base 42 and abutting the tread surface 52 of the sill base 42. The abutment of the fin 102 with the sill base 42 further seals the rail 72 with the sill base 42 for preventing backflow of the fluid 53 toward the interior 26 of the structure 22.

As shown in FIGS. 2 and 8, the threshold assembly 40 includes a biasing member 104 coupled to the rail 72 and contacting the drainage element 56. The biasing member 104 biases the rail 72 away from the drainage element 56 into the initial position. The door panel 38 engages and moves the rail 72 from the initial position to the sealed position, as shown in FIGS. 5-7 and 11, against the biasing of the biasing member 104 as the door panel 38 moves from the open position to the closed position.

As shown in FIGS. 4 and 11, the biasing member 104 is typically disposed between the rail 72 and the drainage element 56. The biasing member 104 is more typically disposed between the body portion 74 of the rail 72 and the drainage surface 66 of the drainage element 56. The biasing member 104 may have a proximal end 106 with the biasing member 104 coupled to the body portion 74 at the proximal end 106. The biasing member is spaced from the hinge portion 76 at the proximal end 106. The biasing member 104 may extend transverse to the body portion 74 to a distal end 108. The biasing member 104 contacts the drainage element 56 at the distal end 108 with the distal end 108 spaced from the hinge portion 76. The distal end 108 of the biasing member 104 contacts the drainage element 56 beneath the rail 72.

As shown in FIG. 4, the biasing member 104 may have a linear configuration with the biasing member 104 linearly extending from the rail 72 to the engagement portion. Typically, the biasing member 104 extends angularly from the rail 72 toward the drainage element 56 such that the biasing member 104 extends away from the hinge portion 76. As the rail 72 moves from the initial position toward the sealed position, as set forth in FIGS. 5-7, the biasing member 104 resiliently flexes about the proximal end 106 relative to the body portion 74 with the distal end 108 simultaneously sliding along the drainage surface 66 away from the hinge portion 76. In the sealed position, the engagement of the biasing member 104 with the drainage surface 66 may seal between the rail 72 and the drainage element 56 for preventing backflow of the fluid 53 into the interior 26 of the structure 22. The resilient flexing of the biasing member 104 about the proximal end 106 facilitates biasing of the rail 72 toward the initial position.

As shown in an alternative embodiment, the biasing member 104 may have a substantially semi-circular configuration with the biasing member 104 tangentially engaging the drainage surface 66 at the distal end 108, as shown in FIG. 11. As the rail 72 moves from the initial position toward the sealed position, the biasing member 104 resiliently elastically deforms such that the distal end 108 of the biasing member 104 engages a greater area of the drainage surface 66, as shown in FIGS. 9 and 11. In the sealed position, the engagement of the biasing member 104 with the greater area of the drainage surface 66 creates a seal between the rail 72 and the drainage element 56 for preventing backflow of the fluid 53 into the interior 26 of the structure 22. The resilient deformation of the biasing member 104 facilitates biasing of the rail 72 toward the initial position. It is to be appreciated that the biasing member 104 may have any configuration for biasing the rail 72 toward the initial position.

Typically, the biasing member 104 extends along the rail 72 toward the first and second door jambs 30, 32. The biasing member 104 may be disposed along the entirety of the rail 72. It is to be appreciated that the biasing member 104 may be disposed along a portion of the rail 72. Furthermore, the biasing member 104 may be segmented such that the biasing member 104 is disposed along portions of the rail 72.

The biasing member 104 shown in FIGS. 2 and 8 is typically comprised of flexible polyvinyl chloride (PVC). However it is to be appreciated that the biasing member 104 may be any other material of suitable flexibility.

As set forth above, typically the body portion 74 is comprised of a rigid plastic and is produced using an extrusion process. The biasing member 104 is typically produced and coupled to the body portion 74 through a co-extrusion process. It is to be appreciated that the process for producing the body portion 74 and the biasing member 104 may be any suitable manufacturing process. Furthermore, it is to be appreciated that the biasing member 104 may be coupled to the body portion 74 in any suitable manner including, but not limited to, fasteners, adhesives, and the like.

As described above, the biasing member 104 is spaced from the hinge portion 76. The spacing of the biasing member 104 from the hinge portion 76 increases the resiliency of the rail 72 because the biasing member 104 provides secondary biasing of the rail 72 toward the initial position. Said differently, the biasing member 104 further biases the rail in conjunction with any internal biasing (memory) of the hinge portion 76 of the rail 72. Additionally, positioning of the biasing member 104 beneath the door panel 38 when the door panel 38 is in the closed position limits a generation of a moment force within the biasing member 104 thereby increases a resiliency of the biasing member 104, itself. Said differently, limiting the moment force acting on the biasing member 104 maintains the elasticity of the biasing member 104.

As described above, the fluid 53 may permeate toward the drainage surface 66 of the drainage element 56. The fluid 53 moves along the drainage surface 66 toward the second side 64 of the drainage element 56. With the rail 72 in the sealed position shown in FIGS. 5-7 and 11, the biasing member 104 minimizes the passage of the fluid 53 between distal end 108 and the drainage surface 66 due to compression of the biasing member 104 against the drainage surface 66. When the rail 72 moves to the initial position shown in FIGS. 2 and 8, the fluid 53 may permeate between the distal end 108 of the biasing member 104 and the drainage surface 66 due to the reduced compression of the biasing member 104 against the drainage surface 66. In one embodiment, as shown in FIG. 4, the fluid 53 passes between the protrusion 70 of the drainage element 56 and the leg portion 78 of the rail 72. The fluid 53 then moves along the tread surface 52 toward the exterior side 44 of the sill base 42. In an alternative embodiment, as shown in FIG. 8, where the drainage element 56 is further defined as the external surface 58 of the sill base 42, upon passing by the biasing member 104, the fluid 53 moves along the tread surface 52 toward the exterior side 44 of the sill base 42. The positive drainage of the fluid 53 that infiltrates the threshold assembly 40 beyond the rail 72 prevents the threshold assembly 40 from retaining the fluid 53 under the rail 72, or worse yet, forcing the fluid 53 into the structure 22. Retention of the fluid 53 under the rail 72 makes the threshold assembly 40 susceptible to mold growth and rot, which is undesirable.

As described above, the rail 72 is typically spaced from both of the first and second door jambs 30, 32. As shown in FIGS. 3 and 10, the entryway system 20 may include a pair of cornerpads 110 individually disposed on the door jambs 30, 32 adjacent the ends 50, 52 and abutting the rail 72 for sealing the opening 34 of the door frame 28 between the door jambs 30, 32 and the rail 72. The each cornerpad 110 independently abut one of the door jambs 30, 32 and the rail 72 to seal between the rail 72 and the door jambs 30, 32 and prevent intrusion of the fluid 53 into the interior 26 of the structure 22.

Each of the cornerpads 110 has a wedge configuration such that the cornerpads 110 extend further away from the door jambs 30, 32 toward the exterior 24 of the structure 22. As such, the rail 72 engages a portion of each of the cornerpads 110 adjacent to the exterior side 44 of the sill base 42. The cornerpads 110 elastically deform between the rail 72 and the door jambs 30, 32 creating a seal that prevents intrusion of water into the interior 26 of the structure 22 between the rail 72 and the door jambs 30, 32.

An example of suitable cornerpads are commercially available under the product name Leading Edge™ Corner Pad produced by Imperial Products by Homeshield, a Quanex Building Products company, is filed under U.S. patent application Ser. No. 11/779,040 which has issued as U.S. Pat. No. 8,240,090, the disclosure of which is incorporated by reference. However, it is to be appreciated that the cornerpads 110 may be any suitable configuration.

Figure 12:
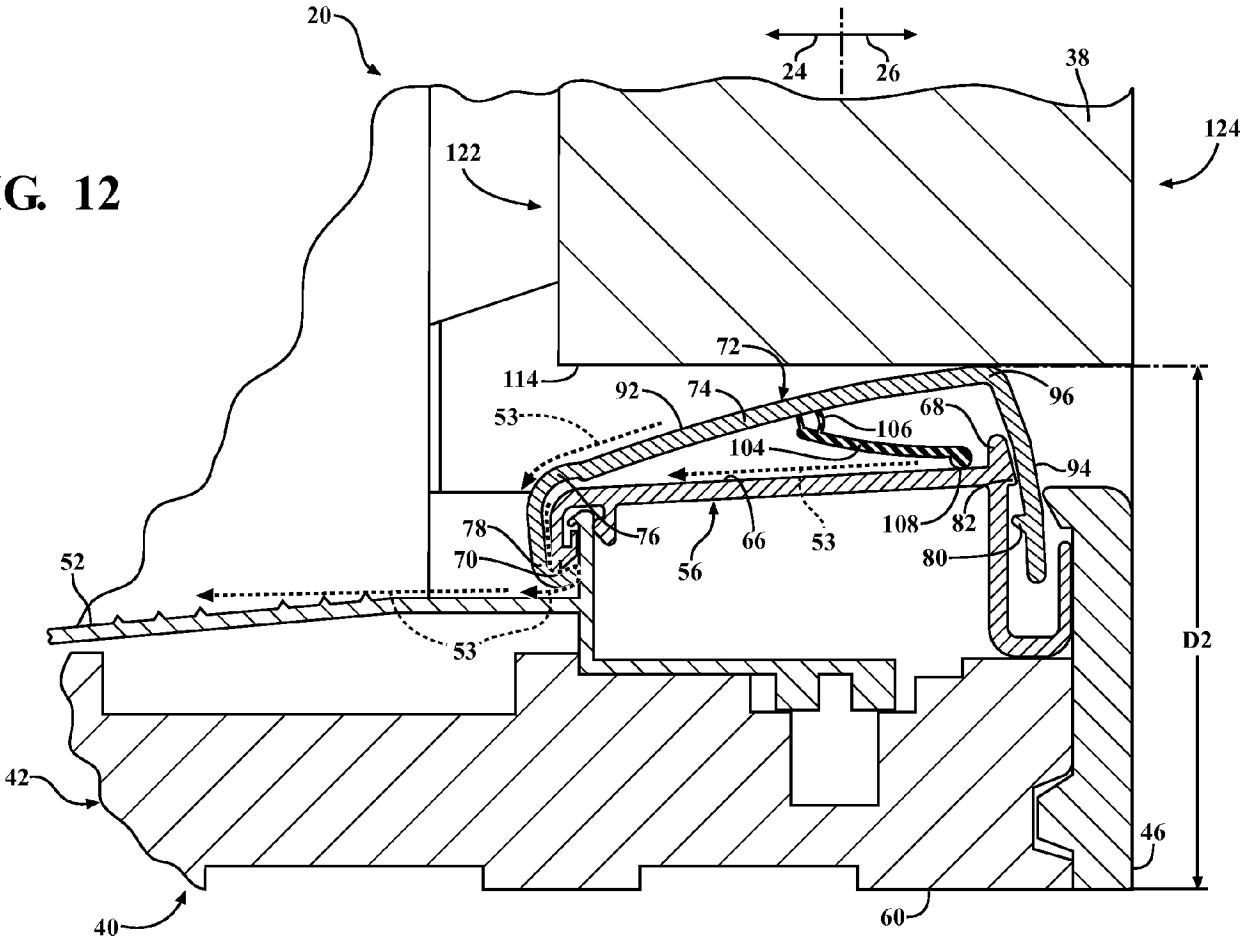
FIG. 12 is a cross-sectional view of the threshold assembly and the door panel along A-A of FIG. 1 with the door panel in the completely closed position and contacting the rail of the threshold assembly.

As described above and shown in FIG. 12, the door panel 38 may engage and move the rail 72 from the initial position to the sealed position as the door panel 38 moves from the open position to the closed position. More specifically, the door panel 38 has a lower surface 114 facing the threshold assembly 40 with the lower surface 114 engaging the rail 72. Alternatively, as shown in FIGS. 2 and 8, the door panel 38 may include a door sweep 112 configured to engage the rail 72 with the door sweep 112 moving the rail 72 from the initial position toward the sealed position as the door panel 38 moves into the closed position against the biasing of the biasing member 104. When present, the door sweep 112 engages the rail 72 for sealing against the rail 72. It is to be appreciated that movement of the rail 72 between the initial position to the sealed position can be accomplished with or without the door sweep 112 present.

Figure 13:
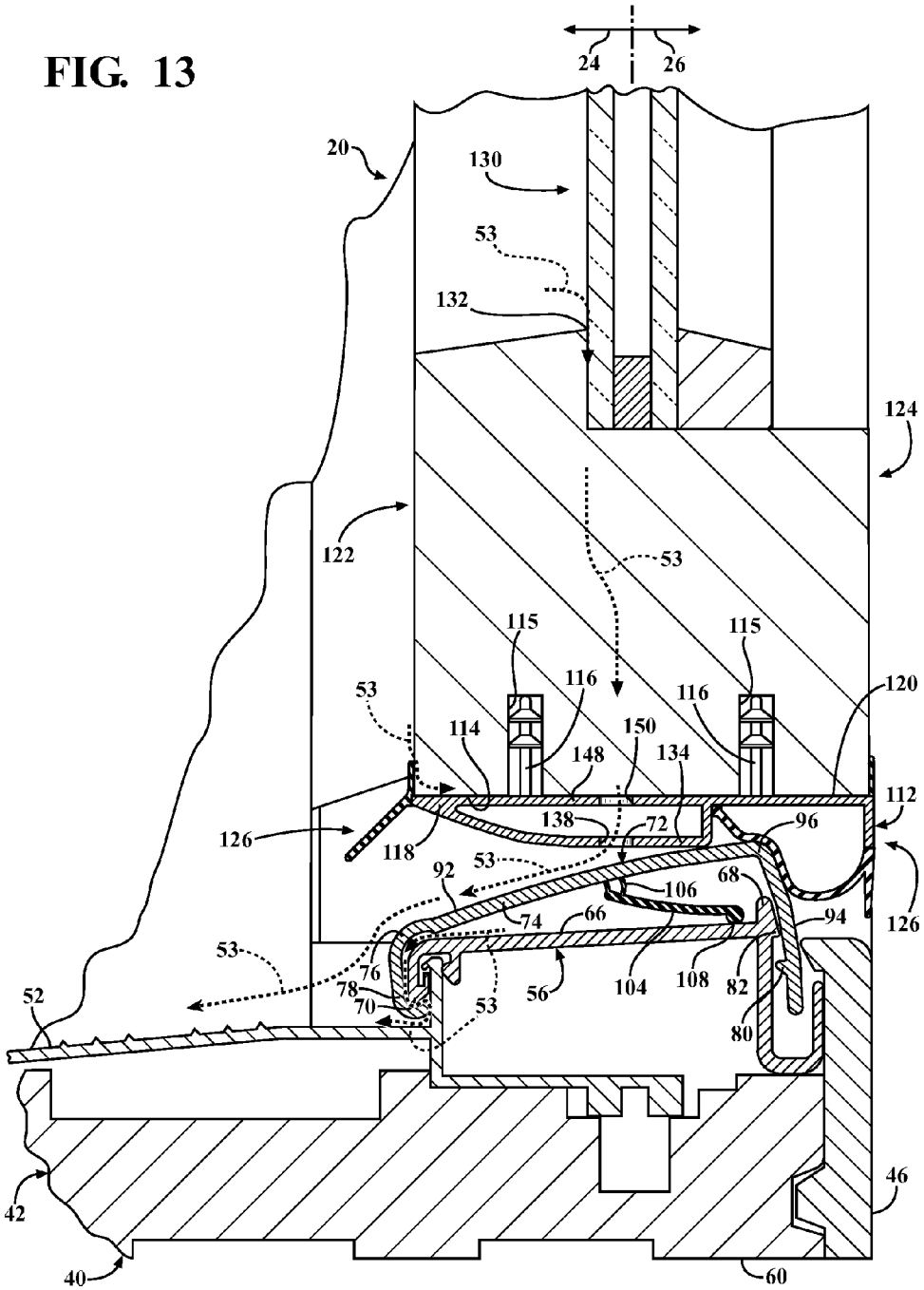
FIG. 13 is a cross-sectional view of the threshold assembly and the door panel along A-A of FIG. 1 with the door panel in the completely closed position and showing the rail having a first, second, third, and fourth segments.
Figure 14:
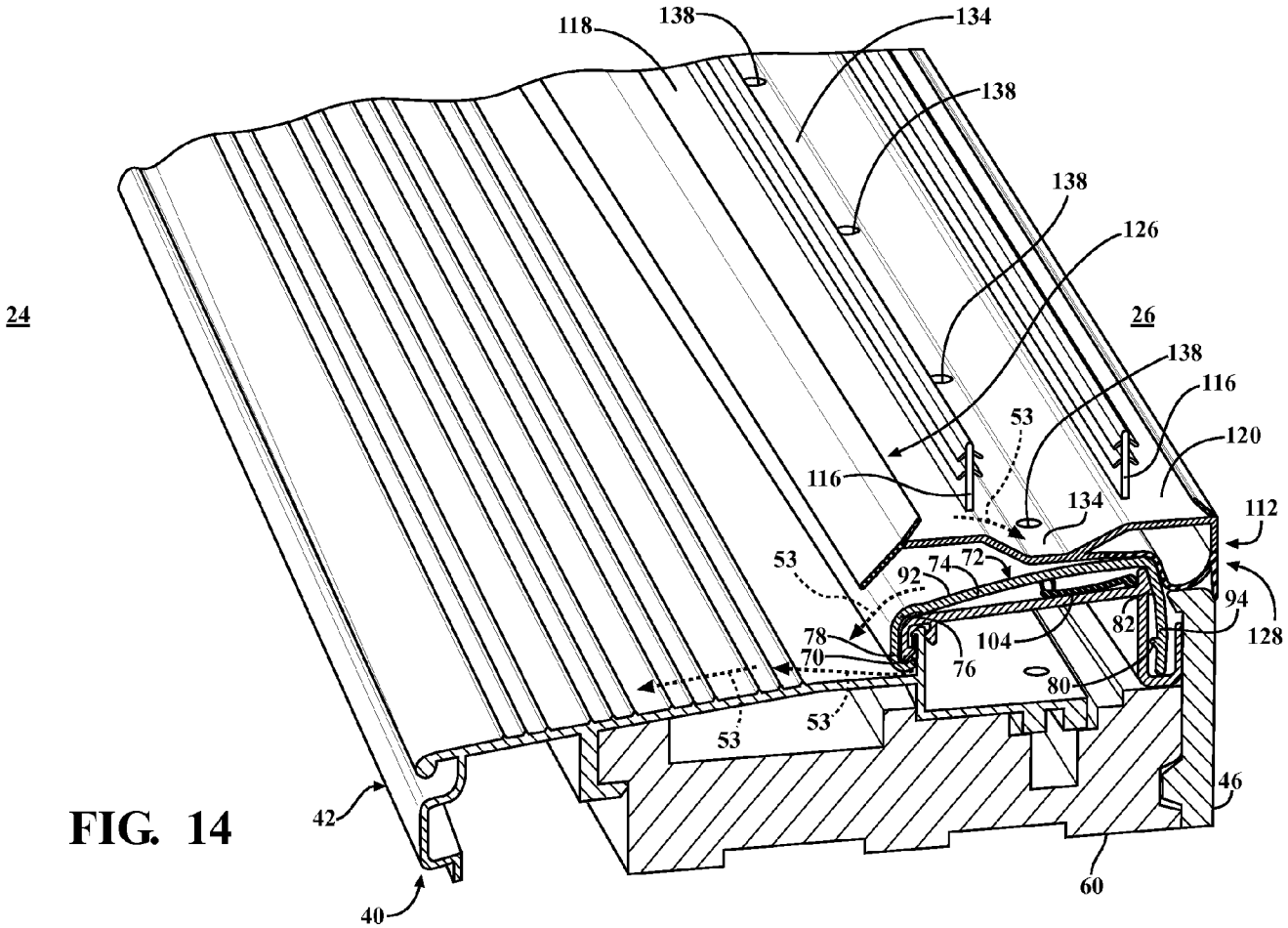
FIG. 14 is a perspective view of a portion of the threshold assembly and a door sweep having the first, second, and third segments and showing a cross-section of the threshold assembly and the door sweep along C-C of FIG. 1 with the door panel in the completely closed position.
Figure 15:
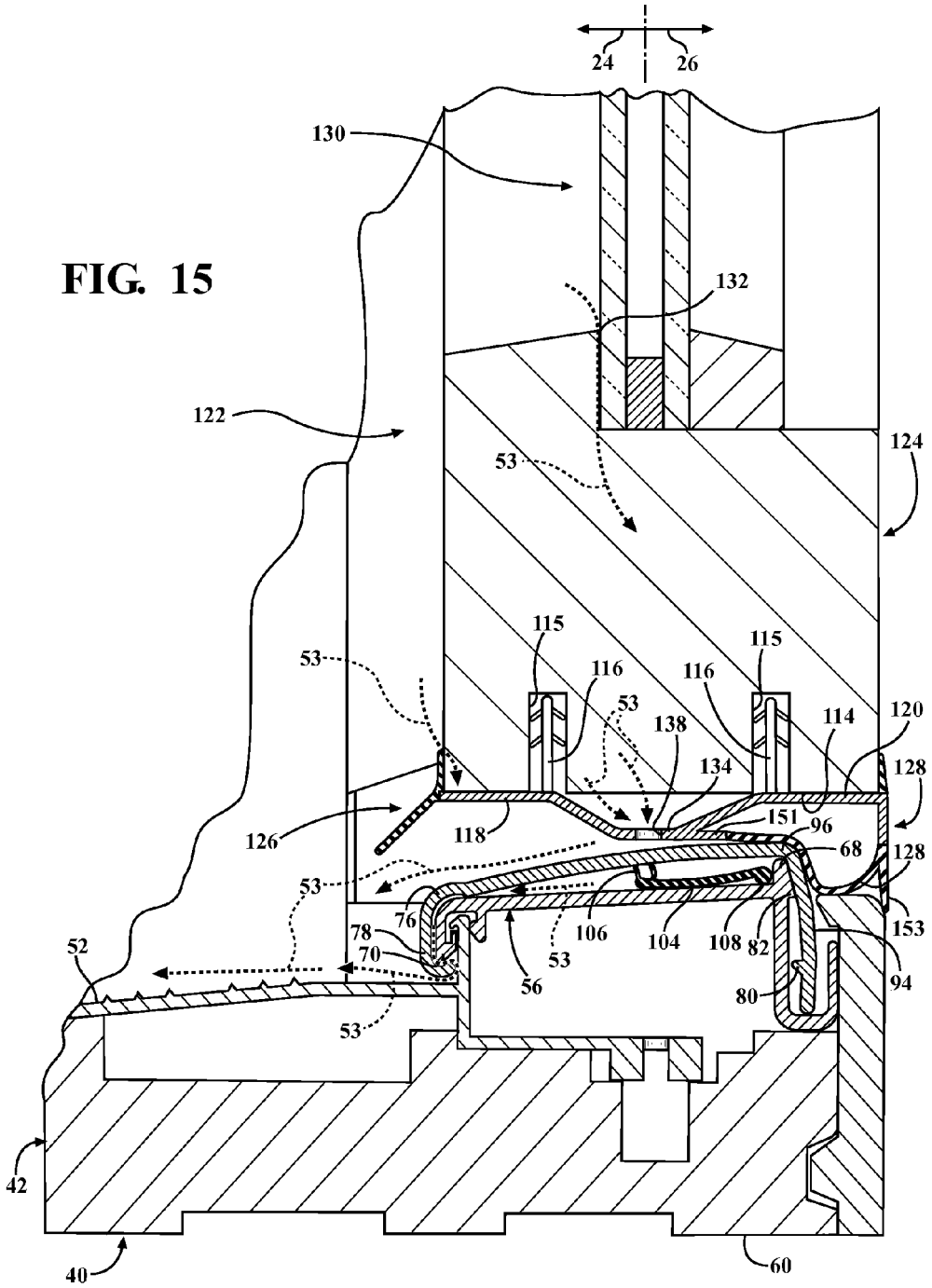
FIG. 15 is a cross-sectional view of the threshold assembly and the door panel showing the door sweep having the first, second, and third segments along C-C of FIG. 1 with the door panel in the completely closed position.

As shown in at least FIG. 9, the door sweep 112 is typically disposed longitudinally along, and coupled to, the lower surface 114 of the door panel 38. As best shown in FIGS. 13 and 15, the lower surface 114 of the door panel 38 may define at least one hole 115. Typically, the hole 115 extends inwardly from the lower surface 114. It is to be appreciated that the hole 115 defined by the lower surface 114 of the door panel 38 may comprise a plurality of holes 115. Additionally, the door sweep 112 may include at least one boss 116 coupled to and extending from the door sweep 112 for engaging the hole or holes 115 of the door panel 38. Generally, engagement of the boss 116 with the hole 115 couples the door sweep 112 to the door panel 38. However, it is to be appreciated that the door sweep 112 may be coupled to the door panel 38 by any suitable method.

With reference to FIGS. 13 and 15-17, the door sweep 112 has a frame. The frame may include a first segment 118 and a second segment 120 spaced from the first segment 118. Said differently, the first and second segments 118, 120 are spaced from one another. The first and second segments 118, 120 are disposed along the lower surface 114 of the door panel 38. For example, the first and second segments 118, 120 may be disposed horizontally along the lower surface 114 of the door panel 38. Generally, the first segment 118 extends to an outside surface 122 of the door panel, as shown in FIGS. 13 and 15. In contrast, the second segment 120 typically extends to an inside surface 124 of the door panel 38, as shown in FIGS. 13 and 15. It is to be appreciated that the outside surface 122 of the door panel 38 faces the exterior 24 of the structure 22 and the inside surface 124 of the door panel 38 faces the interior 26 of the structure 22.

Referring to FIGS. 13 and 15, the door sweep 112 may include an outside seal 126 sealing against the outside surface 122 of the door panel 38 Likewise, the door sweep 112 may include an inside seal 128 sealing against the inside surface 124 of the door panel 38. It is to be appreciated that the outside and inside seals 126, 128 typically contact the outside and inside surfaces 122, 124 of the door panel, respectively. The outside and inside seals 126, 128 prevent the infiltration of the fluid 53 between the door panel 38 and the door sweep 112.

However, it is to be appreciated that the fluid 53 may pass beyond the outside and inside seals 126, 128 resulting in the fluid 53 infiltrating between the door panel 38 and the door sweep 112. Additionally, if the door panel 38 includes an inlay 130, such as a glass panel, the fluid 53 may infiltrate the door panel 38 at a connection point 132 between the inlay 130 and the door panel. Any fluid 53 that infiltrates the door panel 38 at the connection point 132 will migrate to the lower surface 114 of the door panel 38, which has the potential to become trapped between the door sweep 112 and the door panel 38.

The door sweep 112 may include a third segment 134 extending between the first and second segments 118, 120. The third segment 134 is spaced vertically from the first and second segments 118, 120 to define a trough 138 between the first and second segments 118, 120. As such, the third segment 134 is also spaced vertically from the lower surface 114. The trough 136 is configured to collect any fluid 53 that infiltrates to the lower surface 114 of the door panel 38.

With reference to FIGS. 13 and 15-17, the third segment 134 may define at least one drainage port 138 for providing positive drainage from the door sweep 112 such that any fluid 53 that infiltrates into the trough 136 is free to flow through the drainage port 138 to exit the door sweep 112. Said differently, the drainage port 138 defines a drainage path from the door sweep 112 to allow fluid 53 to escape from the door sweep 112. Therefore, any fluid 53 that infiltrates beyond the outside and inside seals 126, 128 and/or infiltrates the door panel 38 at the connection point 132 of the inlay 130 and the door panel 38 can escape the door sweep 112 without being trapped. Typically, the drainage port 138 is spaced from the rail 72 such that any fluid 53 that infiltrates into the trough 136 is free to flow through the drainage port 138 in the third segment 134 to exit the door sweep 112 and onto the rail 72.

Generally, the third segment 134 includes a base portion 142 and a pair of walls 144 extending from the base portion 142 to connect the third segment 134 with the first and second segments 118, 120. In such an embodiment, the base portion 142 of the third segment 134 defines the drainage port 138. It is to be appreciated that the walls 144 of the third segment 134 may each present a sloped configuration between the base portion 142 of the third segment 134 and the first and second segments 118, 120 for collecting any fluid 53 that infiltrates into the trough 136. The sloped configuration of the walls 144 directs any fluid 53 in the trough 136 towards the drainage port 138 so that the fluid 53 can exit the door sweep 112.

It is to be appreciated that the at least one drainage port 138 may comprise a plurality of drainage ports 138 with each of the drainage ports 138 spaced laterally from each other along said door sweep 112. The plurality of drainage ports 138 provides multiple drainage paths along a length of the door sweep 112 for allowing any fluid 53 that enters the trough 136 to exit the door sweep 112 at multiple locations Likewise, the walls 144 may define an additional drainage port 146 for allowing the fluid 53 to exit the door sweep 112. As with the drainage port 138 of the third segment 134, the additional drainage port 146 may be further defined as a plurality of additional drainage ports 146 spaced laterally from each other along the door sweep 112.

Figure 16:
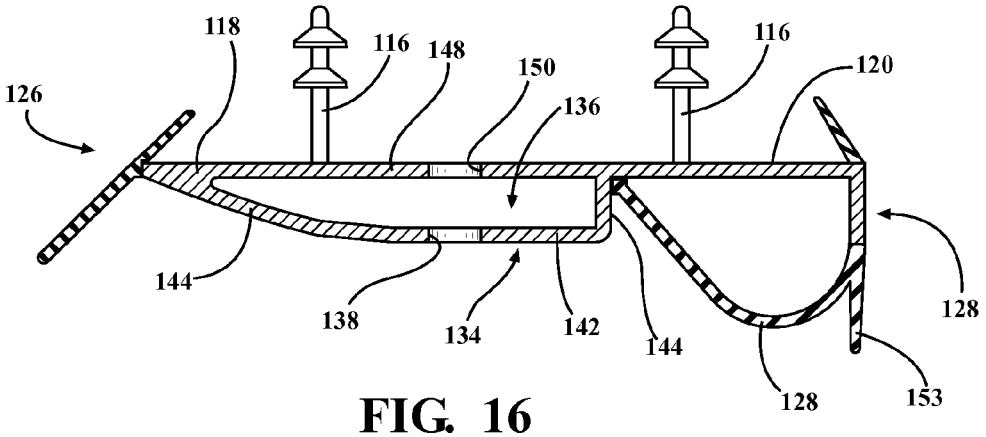
FIG. 16 is a cross-sectional view of the door sweep having the first, second, third, and fourth segments along C-C of FIG. 1.

As shown in FIGS. 13 and 16, the door sweep 112 may include a fourth segment 148 interconnecting the first and second segments 118, 120 with the fourth segment 148. The fourth segment 148 is disposed along the lower surface 114 of the door panel 38. When present, the fourth segment 148 defines another drainage port 150 for allowing any fluid 53 that infiltrates between the door panel 38 and the fourth segment 148 to enter the trough 136.

As described above, the door panel 38 may define a hole 115 and the door sweep 112 may include the boss 116 for coupling the door sweep 112 to the door panel 38. As shown in FIGS. 13 and 15, when present, the boss 116 is coupled to at least one of the first and second segments 118, 120 opposite the third segment 134. More specifically, a first boss 116A is coupled to the first segment 118, and a second boss 116B is coupled to the second segment 120.

Figure 17:
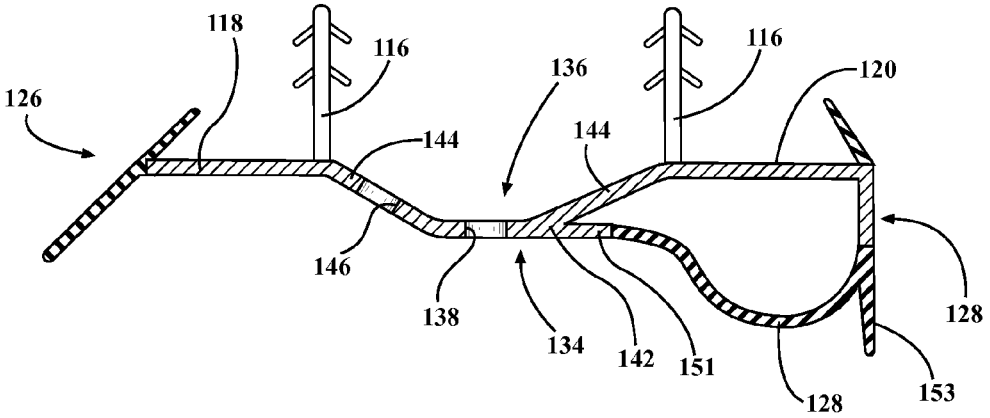
FIG. 17 is a cross-sectional view of the door sweep having the first, second, and third segments along C-C of FIG. 1.

With reference to FIGS. 15 and 17, the door sweep 112 may include a finger 151 extending from the third member 134 for coupling with the inside seal 128. Generally, the finger 151 extends horizontally from the third segment 134. The finger 151 also contacts the rail 72 for moving the rail 72 from the initial position to the sealed position. Connecting the inside seal 128 to the finger 151 increases an area of contact between the inside seal 128 and the rail 72 to provide a more reliable seal.

It is to be appreciated that the inside seal 128 may be a continuous component or comprise segments. When the inside seal 128 comprises segments, some of the segments may be rigid. Additionally, the inside seal 128 may include a flap 153 extending from the inside seal 128 toward the sill base 42. The flap 153 covers a gap between the second segment 120 and the sill base 42. When present, the flap 153 extends longitudinally along the lower surface 114 of the door panel 38. The flap 153 may be substantially coplanar with the interior side 46 of the sill base 42 when the door panel 38 in the completely closed position. The flap 153 may further seal between the door panel 38 and the sill base 42 to prevent negative drainage of the fluid 53 toward the interior side 46 of the sill base 42. Furthermore, the flap 153 may create an aesthetic transition between the door panel 38 and the sill base 42.

With reference to FIG. 11, the door sweep 112 may include a nose 152 for engaging the rail 72. It is to be appreciated that the nose 152 as shown in FIG. 11 is different from the third segment 134 shown in FIGS. 13 and 15. The nose 152 may include a nose seal 154 for engaging the rail 72 to seal beneath the door panel 38. Generally, the nose 152 contacts the apex 96 of the rail 72 for moving the rail 72 between the initial position and the sealed position.

Figure 5:
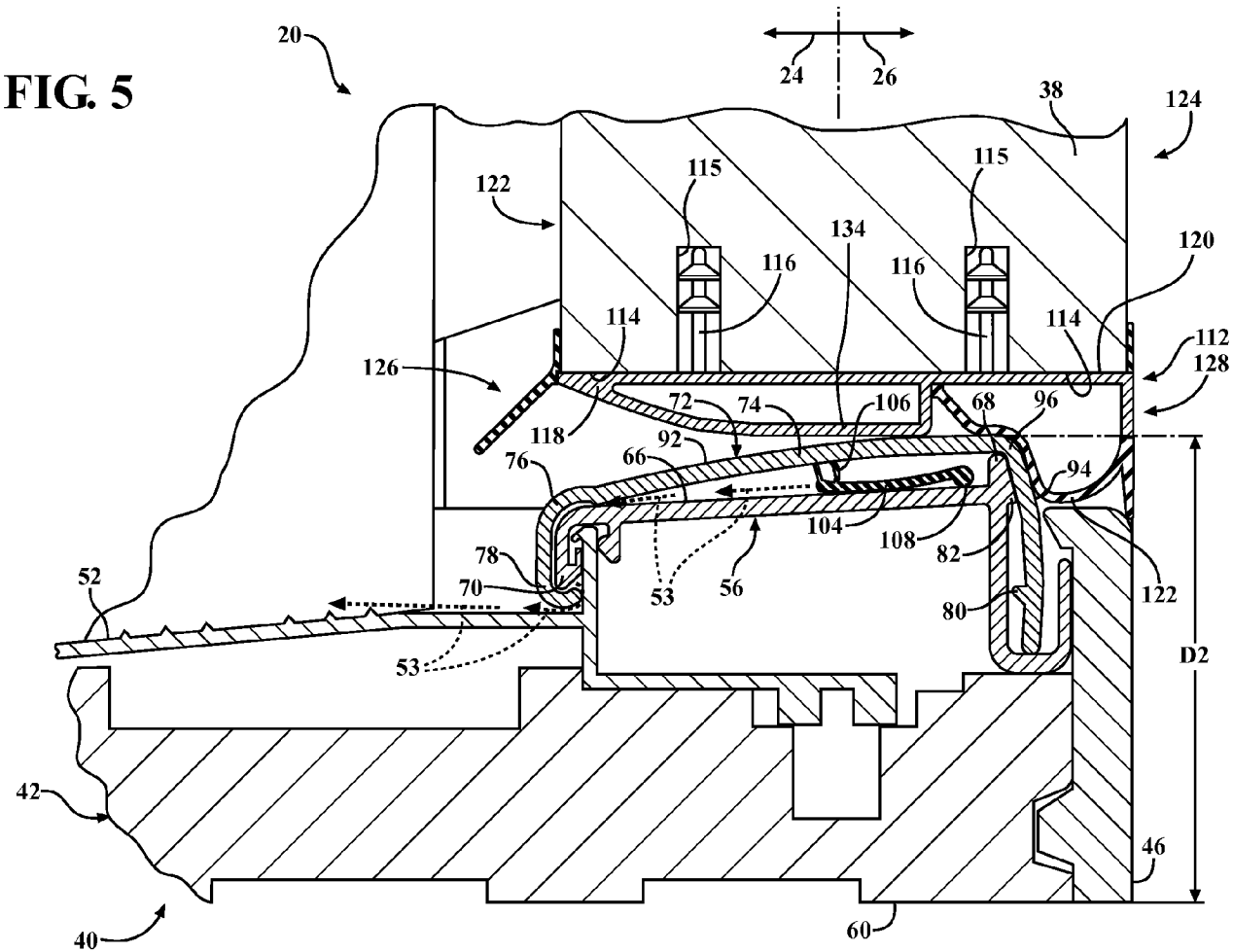
FIG. 5 is a cross-sectional view of the threshold assembly and the door panel along A-A of FIG. 1 with the door panel in a completely closed position and showing the rail in a sealed position with the rail showing an example of a second distance.
Figure 6:
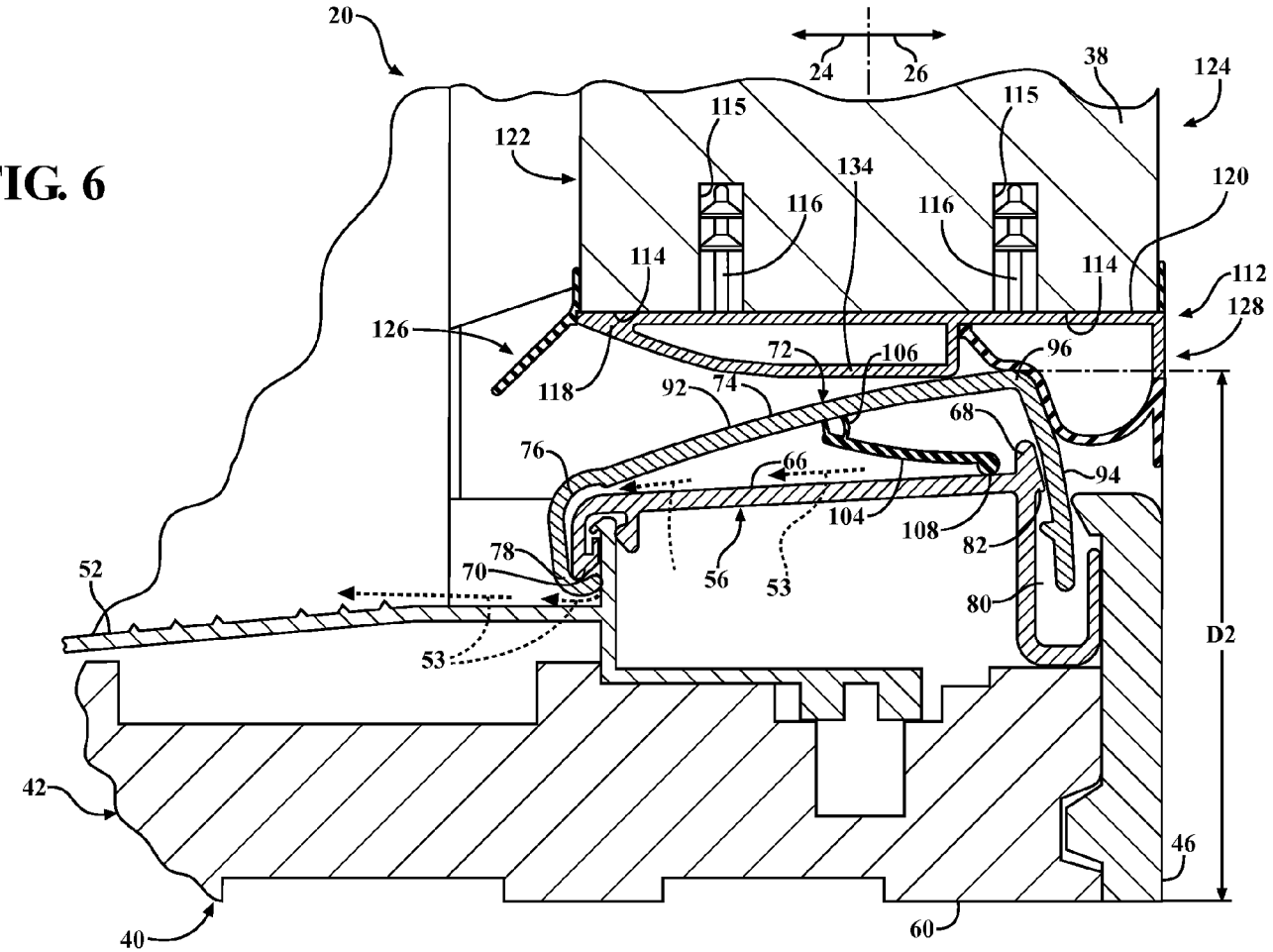
FIG. 6 is a cross-sectional view of the threshold assembly and the door panel along A-A of FIG. 1 with the door panel in the completely closed position and showing the rail in the sealed position with the rail showing an example of an alternative second distance.
Figure 7:
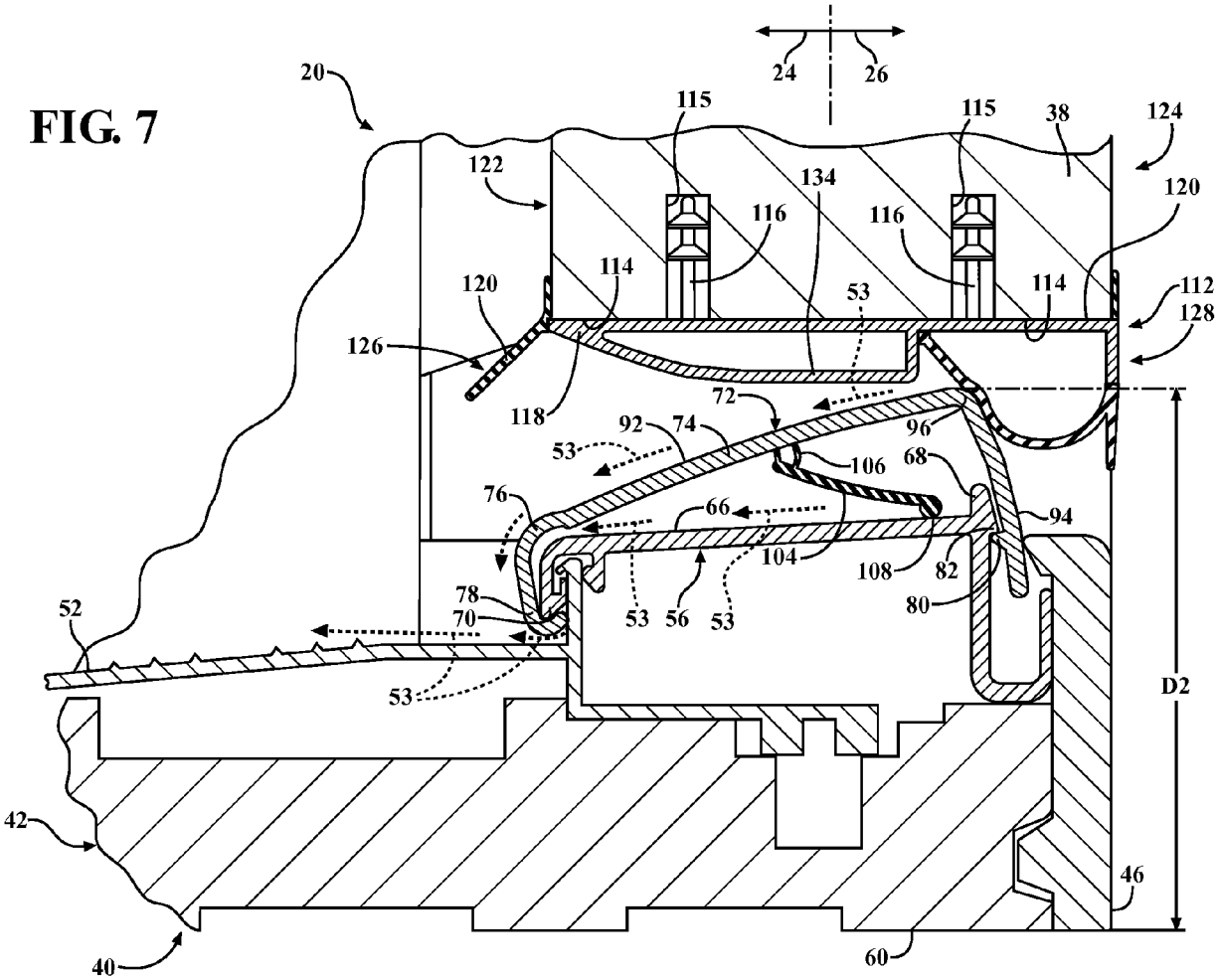
FIG. 7 is a cross-sectional view of the threshold assembly and the door panel along A-A of FIG. 1 with the door panel in the completely closed position and showing the rail in the sealed position with the rail showing an example of another alternative second distance.

Typically, the inside seal 128 can be characterized as a bulb seal, that engages the body portion 74 of the rail 72 when the door panel 38 is in the sealed position. It is also to be appreciated that the inside seal 128 may include multiple inside seals 128 connected to the second segment 120. The sealed position typically refers to any position of the rail 72 when the door panel 38, or the door sweep 112 of the door panel 38, engages the rail 72. As illustrated in FIGS. 5-7, the extent of the pivoting of the body portion 74 about the hinge portion 76 toward the drainage element 56 in the sealed position is dependent upon the proximity of the door panel 38 to the threshold assembly 40. The proximity of the door panel 38 to the threshold assembly 40 may vary longitudinally along the threshold assembly 40. Such variations in the proximity of the door panel 38 to the threshold assembly 40 may be a result of the alignment of the door panel 38 or the threshold assembly 40 within the entryway system 20. The variations in the proximity of the door panel 38 to the threshold assembly 40 may further be a result of non-planar configuration of the lower surface 114 or the door sweep 112.

As the lower surface 114 of the door panel 38, and door sweep 112 coupled to the lower surface 114, extends further toward the threshold assembly 40, the body portion 74 of the pivots further toward the drainage element 56. The second distance D2 of the rail 72 in the sealed position may be any one of a plurality of distances. FIGS. 5, 6, and 7 illustrate three of the plurality of second distances D2 in the sealed position. More specifically, FIG. 5 illustrates an example of the body portion 74 of the rail 72 extensively pivoted about the hinge portion 76 and having one of the plurality of second distances D2. FIG. 6 illustrates an example of the body portion 74 of the rail 72 moderately pivoted about the hinge portion 76 and having another one of the plurality of second distances D2. FIG. 7 illustrates an example of the body portion 74 of the rail 72 minimally pivoted about the hinge portion 76 and having yet another one of the plurality of second distances D2. It is to be appreciated that the second distance D2 of the rail 72 may be any distance. Furthermore, although the examples set forth in FIGS. 5-7 above illustrate the plurality of second distances D2 for one embodiment of the invention, it is to be appreciated that the plurality of second distances exemplified by FIGS. 5-7 may be applicable to all embodiments of the subject invention.

As described above, the rail 72 may extend between first and second ends 48, 50 of the sill base 42. The second distance D2 of the rail 72 may vary longitudinally along the rail 72. More specifically, changes in the proximity of the lower surface 114 of the door panel 38 and door sweep 112 toward threshold assembly 40 longitudinally along the rail 72 facilitates varying pivoting of the body portion 74 about the hinge portion 76 along the sill base 42 and varying second distances D2 along the sill base 42. The varying to the second distance D2 of the rail 72 along the door sweep 112 disposed on the lower surface 114 of the door panel 38 ensures engagement of the rail 72 with the door panel 38 longitudinally along the threshold assembly 40.

It is to be appreciated that door sweep 112 described above can be used with any threshold assembly capable. For example, the door sweep 112 can be used with a threshold assembly having a fixed rail or an adjustable rail.

The operation of moving of the door panel 38 from the open position, as shown in FIGS. 2 and 8, to the closed position (more specifically the completely closed position as shown in FIGS. 5, 9, and 11) and concurrent movement of the rail 72 from the initial position to the sealed position will be discussed below for illustrative purposes only.

Beginning with the door panel 38 in the open position and the rail 72 in the initial position, as shown in FIGS. 2 and 8, the door panel 38 is pivoted relative to the first door jamb 30 toward the closed position. The door panel 38 or, if present, the door sweep 112 engages the body portion 74 of the rail 72 adjacent the first door jamb 30 which facilitates pivoting of the body portion 74 relative to the hinge portion 76. The engagement of the door panel 38 or, if present, the door sweep 112 with body portion 74 of the rail 72 adjacent the first door jamb 30 is within the range of closed positions as described above. The door panel 38 or, if present, the door sweep 112 progressively engages the body portion 74 along the rail 72 moving away from the first door jamb 30 toward the second door jamb 32 as the door panel 38 continues to pivot toward the completely closed position, as shown in FIGS. 5-7 and 11.

The inside seal 128 abuts and seals against the body portion 74 of the rail 72. The body portion 74 of the rail 72 is further pivoted about the hinge portion 76 into the sealed position. With the door panel 38 in the completely closed position, the entire rail 72 is disposed in the sealed position with the second distance D2 of the rail 72 varying longitudinally along the rail 72 to accommodate engagement of the rail 72 with the inside seal 128 of the door sweep 112. Engagement of the rail 72 with the inside seal 128 seals the opening 34 between the threshold assembly 40 and the door panel 38.

The invention has been described in an illustrative manner, and it is to be understood that the terminology which has been used is intended to be in the nature of words of description rather than of limitation. As is now apparent to those skilled in the art, many modifications and variations of the subject invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An entryway system for disposing within an aperture of a structure which has an exterior and an interior, said entryway system comprising:

a door frame having first and second door jambs spaced from each other, said door frame defining an opening for providing access between the interior and the exterior;

a door panel coupled to said door frame and capable of moving between an open position and a closed position with said door panel disposed in said opening in said closed position; and a threshold assembly disposed between said first and second door jambs and below said door panel with said door panel contacting said threshold assembly in said closed position, said threshold assembly comprising:

a sill base extending between an exterior side which faces the exterior of the structure and an interior side which faces the interior of the structure;

a rail coupled to and disposed above said sill base with said rail movable relative to said sill base between an initial position having a first distance relative to said sill base when said door panel is in said open position, and a sealed position having a second distance relative to said sill base when said door panel is in said closed position, wherein said first distance is greater than said second distance for allowing said rail to adjust closer to said sill base;

a drainage element disposed beneath said rail and having a height relative to said sill base with said drainage element sloping away from said interior side of said sill base such that said height of said drainage element decreases from said interior side of said sill base to said exterior side of said sill base for providing positive drainage of any fluid that may infiltrate beyond said rail from said threshold assembly at said exterior side; and a biasing member coupled to said rail and contacting said drainage element with said biasing member biasing said rail away from said drainage element into said initial position, wherein said door panel engages and moves said rail from said initial position to said sealed position against said biasing of said biasing member as said door panel moves from said open position to said closed position.

2. The entryway system as set forth in claim 1 wherein said door panel further includes a lower surface facing said threshold and said door panel includes a door sweep coupled to the lower surface with said door sweep configured to engage said rail with said door sweep moving said rail from said initial position toward said sealed position as said door panel moves toward said closed position against said biasing of said biasing member for sealing against said rail.

3. The entryway system as set forth in claim 1 wherein said sill base extends between a first end and a second end defining a width of the sill base with said first end adjacent said first door jamb and said second end adjacent said second door jamb.

4. The entryway system as set forth in claim 3 wherein said rail extends between said first and second ends of said sill base with said door panel engaging said rail along said width of said sill base for sealing said opening of said door frame beneath said door panel.

5. The entryway system as set forth in claim 3 further including a pair of cornerpads individually disposed on said door jambs adjacent said ends and abutting said rail for sealing said opening of said door frame between said door jambs and said rail.

6. A threshold assembly for use with an entryway system disposed within an aperture of a structure, which has an exterior and an interior, said threshold assembly comprising:

a sill base extending between an exterior side for facing the exterior of the structure and an interior side for facing the interior of the structure;

a rail coupled to and disposed above said sill base with said rail movable relative to said sill base between an initial position having a first distance relative to said sill base and a sealed position having a second distance relative to said sill base with said first distance greater than said second distance for allowing said rail to adjust closer to said sill base;

a drainage element disposed beneath said rail and having a height relative to said sill base with said drainage element sloping away from said interior side of said sill base such that said height of said drainage element decreases from said interior side of said sill base to said exterior side of said sill base for providing positive drainage of any fluid that may infiltrate beyond said rail from said threshold assembly at said exterior side; and a biasing member coupled to said rail and contacting said drainage element with said biasing member biasing said rail away from said drainage element into said initial position.

7. The threshold assembly as set forth in claim 6 wherein said biasing member is disposed between said rail and said drainage element.

8. The threshold assembly as set forth in claim 6 wherein said drainage element defines a drainage surface disposed beneath and facing said rail, said drainage surface extending toward said interior and exterior sides of said sill base with said drainage surface defining said sloping away of said drainage element.

9. The threshold assembly as set forth in claim 6 wherein said rail has a body portion and a hinge portion coupled to said body portion with said hinge portion coupled to said drainage element and said movement of said rail is further defined as pivoting said body portion relative to said sill base about said hinge portion.

10. The threshold assembly as set forth in claim 9 wherein said biasing member has a proximal end with said biasing member coupled to said body portion at said proximal end and said biasing member spaced from said hinge portion at said proximal end.

11. The threshold assembly as set forth in claim 10 wherein said biasing member extends transverse to said body portion to a distal end and contacts said drainage element at said distal end with said distal end spaced from said hinge portion.

12. The threshold assembly as set forth in claim 11 wherein said distal end of said biasing member contacts said drainage element beneath said rail.

13. The threshold assembly as set forth in claim 9 wherein said rail includes a leg portion extending from said hinge portion opposite said body portion for coupling said hinge portion with said drainage element.

14. The threshold assembly as set forth in claim 13 wherein said drainage element has a protrusion with said leg portion wrapped around said protrusion for coupling said hinge portion with said drainage element.

15. The threshold assembly as set forth in claim 9 wherein said body portion extends from said hinge portion toward said interior side of said sill base.

16. The threshold assembly as set forth in claim 9 wherein said hinge portion is further defined as a living hinge with said body portion pivoting about said living hinge relative to said sill base.

17. The threshold assembly as set forth in claim 6 wherein said rail has a primary surface sloping away from said interior side of said sill base for providing positive drainage off of said rail toward said exterior side of said sill base.

18. The threshold assembly as set forth in claim 17 wherein said rail has a secondary surface adjacent said primary surface and defining a channel for preventing negative drainage off of said rail toward said interior side of said sill base.

19. The threshold assembly as set forth in claim 18 wherein said rail has a body portion and a hinge portion coupled to said body portion wherein said primary and secondary surfaces are disposed on said body portion.

20. The threshold assembly as set forth in claim 19 wherein said body portion extends from said hinge portion toward said exterior side of said sill base.

21. The threshold assembly as set forth in claim 6 wherein said sill base has an external surface and said drainage element is further defined as said external surface of said sill base.

22. The threshold assembly as set forth in claim 6 wherein said rail has a first hook and said drainage element has a second hook with said first hook selectively engaging said second hook for coupling said rail to said sill base.

23. The threshold assembly as set forth in claim 6 wherein said drainage element defines a dam extending toward said rail for preventing backflow toward said interior side of said sill base.

24. A threshold assembly for use with an entryway system disposed within a structure having an exterior and an interior, said threshold assembly comprising:

a sill base extending between an exterior side facing the exterior of the structure and an interior side facing the interior of the structure;

a rail coupled to and disposed above said sill base with said rail movable relative to said sill base between an initial position having a first distance relative to said sill base and a sealed position having a second distance relative to said sill base with said first distance greater than said second distance for preventing intrusion of a fluid from the exterior to the interior of the structure;

a drainage element disposed beneath said rail and having a height relative to said sill base with said drainage element sloping away from said interior side of said sill base such that said height of said drainage element decreases from said interior side of said sill base to said exterior side of said sill base for providing positive drainage of the fluid having penetrated between said rail and said sill base from said threshold assembly at said exterior side; and a biasing member disposed between said rail and said drainage element with said biasing member coupled to said rail and contacting said drainage element, said biasing member biasing said rail away from said drainage element into said initial position;

wherein said rail has a body portion and a hinge portion coupled to said body portion with said hinge portion coupled to said drainage element and said movement of said rail is further defined as pivoting said body portion relative to said sill base about said hinge portion with said rail including a leg portion extending from said hinge portion opposite said body portion and said drainage element has a protrusion with said leg portion wrapped around said protrusion for coupling said hinge portion with said drainage element.

* * * * *